US010094635B2

(12) United States Patent
Holmes et al.

(10) Patent No.: US 10,094,635 B2
(45) Date of Patent: Oct. 9, 2018

(54) AXIALLY OFFSET FOREGRIP FOR A FIREARM AND RELATED DEVICES, SYSTEMS, AND METHODS

(71) Applicant: Ryker USA, Inc., Cary, NC (US)

(72) Inventors: Ron Wesley Holmes, Wilmington, NC (US); Joshua Ward Robertson, Cary, NC (US); Jacob Matthew Joubert, Garner, NC (US)

(73) Assignee: Ryker USA, Inc., Cary, NC (US)

( * ) Notice: Subject to any disclaimer, the term of this patent is extended or adjusted under 35 U.S.C. 154(b) by 0 days.

(21) Appl. No.: 15/467,784

(22) Filed: Mar. 23, 2017

(65) Prior Publication Data

US 2017/0191792 A1 Jul. 6, 2017

Related U.S. Application Data

(63) Continuation-in-part of application No. 15/040,462, filed on Feb. 10, 2016, now abandoned.

(60) Provisional application No. 62/115,122, filed on Feb. 11, 2015.

(51) Int. Cl.
*F41C 23/16* (2006.01)
*F41C 23/14* (2006.01)

(52) U.S. Cl.
CPC ..... *F41C 23/16* (2013.01); *F41C 23/14* (2013.01)

(58) Field of Classification Search
CPC ..... F41C 23/12; F41C 23/16; F41C 23/22; F41C 23/14
USPC ..... 42/72, 90, 106, 84
See application file for complete search history.

(56) References Cited

U.S. PATENT DOCUMENTS 2,104,129 A * 1/1938 Kress ..... F41C 23/16 42/71.01
2,386,802 A * 10/1945 Johnson, Jr. ..... F41A 23/00 42/71.01
2,436,175 A * 2/1948 Neal ..... F41A 3/26 42/16
2,926,448 A * 3/1960 Stam ..... F41C 23/16 42/71.01
2,977,703 A * 4/1961 Sarvis ..... F41A 19/07 42/1.11

(Continued)

OTHER PUBLICATIONS

Non-Final Office Action for U.S. Appl. No. 15/040,462, dated Jun. 27, 2016, 7 pages.

(Continued)

*Primary Examiner* — Jonathan C Weber
(74) *Attorney, Agent, or Firm* — Sage Patent Group

(57) ABSTRACT

An axially offset foregrip assembly for a long gun has a grip portion having a first grip axis, with a middle portion of the grip portion configured to be grasped by a hand of a user about the first grip axis. The foregrip assembly also has a coupling portion for coupling between the middle portion of the grip portion and a fore-end of a long gun. The long gun has a barrel having a longitudinal axis and a rear grip having a second grip axis, which together define a vertical barrel plane. The coupling portion is configured to couple the grip portion to the fore-end of the long gun such that the first grip axis is in a vertical grip plane horizontally offset from the vertical barrel plane, with the vertical grip plane and the first grip axis substantially parallel to the vertical barrel plane.

20 Claims, 29 Drawing Sheets

(56) References Cited

U.S. PATENT DOCUMENTS 3,164,920 A * 1/1965 Haas, Jr. ..... F41C 23/16 42/71.01
4,321,765 A * 3/1982 Gillum ..... F41C 23/10 42/72
4,416,186 A * 11/1983 Sullivan ..... F41A 3/26 89/198
4,502,238 A * 3/1985 Farrar ..... F41A 35/06 42/71.02
4,579,037 A * 4/1986 Gillum ..... F41A 3/62 42/72
4,689,912 A * 9/1987 Gillum ..... F41A 3/10 42/105
4,827,652 A * 5/1989 Martin ..... F41A 3/72 42/111
4,837,961 A * 6/1989 Keenan ..... F41C 7/025 42/72
5,417,002 A * 5/1995 Guerra ..... F41C 23/16 42/72
6,374,528 B1 * 4/2002 Davis ..... F41C 23/00 42/71.01
D470,379 S * 2/2003 Andriolo ..... D8/68
6,598,329 B1 * 7/2003 Alexander ..... F41C 23/04 42/114
6,655,069 B2 * 12/2003 Kim ..... F41G 11/003 42/114
6,851,214 B2 * 2/2005 Oz ..... F41G 1/35 42/111
6,901,691 B1 * 6/2005 Little ..... F41A 23/02 42/118
7,434,344 B2 * 10/2008 Golan ..... F41C 23/04 42/72
7,490,429 B2 * 2/2009 Moody ..... F41A 23/08 248/171
7,559,167 B1 * 7/2009 Moody ..... F41G 11/003 42/71.01
7,568,304 B1 * 8/2009 Moody ..... F41A 23/08 42/71.01
7,665,239 B1 * 2/2010 Moody ..... F41A 23/08 42/72
7,818,910 B2 * 10/2010 Young ..... F41C 23/16 42/106
8,225,542 B2 * 7/2012 Houde-Walter ..... F41A 35/00 42/72
8,245,428 B2 * 8/2012 Griffin ..... F41C 23/16 42/72
8,429,843 B2 * 4/2013 Yan ..... F41C 23/12 42/71.01
D693,424 S * 11/2013 Wristen ..... D22/108
8,607,492 B2 * 12/2013 Hartley ..... F41C 23/16 42/72
8,683,733 B2 * 4/2014 Gross ..... F41C 23/16 362/110
8,757,040 B1 * 6/2014 Galloway ..... F41C 23/02 89/1.42
8,782,942 B1 * 7/2014 Bentley ..... F41C 7/02 42/71.01
2003/0106251 A1 * 6/2003 Kim ..... F41G 11/003 42/71.01
2005/0115140 A1 * 6/2005 Little ..... F41A 23/02 42/118
2005/0241206 A1 * 11/2005 Teetzel ..... F41C 23/16 42/72
2006/0064913 A1 * 3/2006 Gablowski ..... F41C 23/16 42/72
2006/0191183 A1 * 8/2006 Griffin ..... F41C 23/16 42/72
2008/0010890 A1 * 1/2008 Vice ..... F41C 23/16 42/72
2008/0209789 A1 * 9/2008 Oz ..... F41G 1/35 42/90
2009/0044439 A1 * 2/2009 Phillips ..... F41C 23/14 42/72
2009/0140015 A1 * 6/2009 Faifer ..... F41C 23/16 224/191
2009/0193702 A1 * 8/2009 Lin ..... F41C 23/16 42/72
2009/0287363 A1 * 11/2009 Young ..... F41C 23/16 701/2
2010/0031552 A1 * 2/2010 Houde-Walter ..... F41A 35/00 42/72
2010/0229448 A1 * 9/2010 Houde-Walter ..... F41C 23/16 42/72
2010/0263255 A1 * 10/2010 Harris ..... F41C 27/00 42/90
2011/0047851 A1 * 3/2011 Mock ..... F41C 23/16 42/72
2011/0107643 A1 * 5/2011 Fitzpatrick ..... F41C 23/16 42/72
2011/0167707 A1 * 7/2011 Gross ..... F41C 23/16 42/114
2011/0198471 A1 * 8/2011 Marquez ..... F41A 11/02 248/316.4
2011/0255270 A1 * 10/2011 Gross ..... F41C 23/16 362/110
2012/0055061 A1 * 3/2012 Hartley ..... F41C 23/16 42/84
2012/0117844 A1 * 5/2012 Sweet ..... F41C 23/16 42/72
2012/0285067 A1 * 11/2012 Kitzen ..... F41G 11/003 42/90
2014/0182182 A1 * 7/2014 Adcock, Jr. ..... F41C 27/16 42/72
2014/0215884 A1 * 8/2014 Adcock, Jr. ..... F41B 13/00 42/72
2014/0230303 A1 * 8/2014 Rice ..... F41C 27/16 42/90
2015/0233668 A1 * 8/2015 Moore ..... F41C 23/16 42/72
2016/0061560 A1 * 3/2016 Saadon ..... F41G 11/003 42/72
2016/0231080 A1 8/2016 Holmes et al.

OTHER PUBLICATIONS

Final Office Action for U.S. Appl. No. 15/040,462, dated Dec. 23, 2016, 10 pages.
Non-Final Office Action for U.S. Appl. No. 15/040,462, dated Jun. 16, 2017, 10 pages.

* cited by examiner

AXIALLY OFFSET FOREGRIP FOR A FIREARM AND RELATED DEVICES, SYSTEMS, AND METHODS

RELATED APPLICATIONS

This application is a continuation-in-part of co-pending U.S. patent application Ser. No. 15/040,462, filed on Feb. 10, 2016, entitled "AXIALLY OFFSET FOREGRIP FOR A FIREARM AND RELATED DEVICES, SYSTEMS, AND METHODS," which claims the benefit of U.S. Provisional Application No. 62/115,122, filed on Feb. 11, 2015, entitled "FORWARD INLINE STABILITY TARGETING (FIST) GRIPS FOR A FIREARM AND METHODS," the disclosures of each of which are hereby incorporated herein by reference in their entireties.

TECHNICAL FIELD

The presently disclosed subject matter relates generally to firearm grips and more particularly to an axially offset foregrip for a firearm, and related devices, systems, and methods.

BACKGROUND

Generally speaking, a long gun or long rifle is any rifle or shotgun that is designed to be used by a single person and fired from the shoulder. Examples of long guns include, but are not limited to, a hunting rifle, a shotgun, and military carbine type rifles, such the AR-15 rifle and the M4A 1 rifle. The carbine type rifles can be semi-automatic or fully automatic weapons.

Certain long rifles, such as military carbine type rifles, can have both a rear grip (such as, for example, a pistol grip) and a foregrip (such as, for example, a vertical foregrip, front grip, forward grip, or forward hand grip). Foregrips are used, for example, to help control a muzzle of the rifle, to keep a shooter's hand away from a hot barrel, and to control recoil. A conventional rear grip and the foregrip are commonly installed in line with each other, in the vertical plane of the rifle barrel.

SUMMARY

According to one embodiment, an axially offset foregrip assembly for a long gun is disclosed. The foregrip assembly comprises a grip portion having a first grip axis, the grip portion having a middle portion configured to be grasped by a hand of a user about the first grip axis. The foregrip further comprises a coupling portion coupled to the middle portion of the grip portion, the coupling portion configured to be coupled to a fore-end of a long gun. The long gun comprises a barrel having a longitudinal axis and a rear grip having a second grip axis, the longitudinal axis and the second grip axis defining a vertical barrel plane. The coupling portion is configured to couple the grip portion to the fore-end of the long gun such that the first grip axis is in a vertical grip plane horizontally offset from the vertical barrel plane, the vertical grip plane is substantially parallel to the vertical barrel plane, and the first grip axis is substantially parallel to the vertical barrel plane.

According to another embodiment, a long gun is disclosed. The long gun comprises a fore-end comprising a barrel having a longitudinal axis. The long gun further comprises an axially offset foregrip sub-assembly coupled to the fore-end. The foregrip sub-assembly comprises a grip portion having a first grip axis, the grip portion having a middle portion configured to be grasped by a hand of a user about the first grip axis. The foregrip sub-assembly further comprises a coupling portion coupled between the middle portion of the grip portion and the fore-end. The long gun further comprises a rear grip having a second grip axis, the longitudinal axis and the second grip axis defining a vertical barrel plane. The first grip axis is in a vertical grip plane horizontally offset from the vertical barrel plane. The vertical grip plane is substantially parallel to the vertical barrel plane. The first grip axis is substantially parallel to the vertical barrel plane.

According to another embodiment, an axially offset foregrip assembly for a long gun is disclosed. The foregrip assembly comprises a grip portion having a first grip axis, the grip portion having a middle portion configured to be grasped by a hand of a user about the first grip axis. The foregrip assembly further comprises a coupling portion coupled to the middle portion of the grip portion, the coupling portion configured to be coupled to a fore-end of a long gun, the long gun comprising a barrel having a longitudinal axis. The coupling portion is configured to couple the grip portion to the fore-end of the long gun such that the first grip axis is horizontally offset from the longitudinal axis of the barrel, and the first grip axis is non-coplanar with the longitudinal axis of the barrel.

Those skilled in the art will appreciate the scope of the disclosure and realize additional aspects thereof after reading the following detailed description of the embodiments in association with the accompanying drawing figures.

BRIEF DESCRIPTION OF THE DRAWINGS

The accompanying drawing figures incorporated in and forming a part of this specification illustrate several aspects of the disclosure and, together with the description, serve to explain the principles of the disclosure.

DETAILED DESCRIPTION

The embodiments set forth below represent the information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first end" and "second end," and does not imply a priority, a type, an importance, or other attribute, unless otherwise stated herein. The terms "about" and "substantially" used herein in conjunction with a numeric value means any value that is within a range of ten percent greater than or ten percent less than the numeric value.

As used herein and in the claims, the articles "a" and "an" in reference to an element refers to "one or more" of the element unless otherwise explicitly specified.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

Figure 1A:
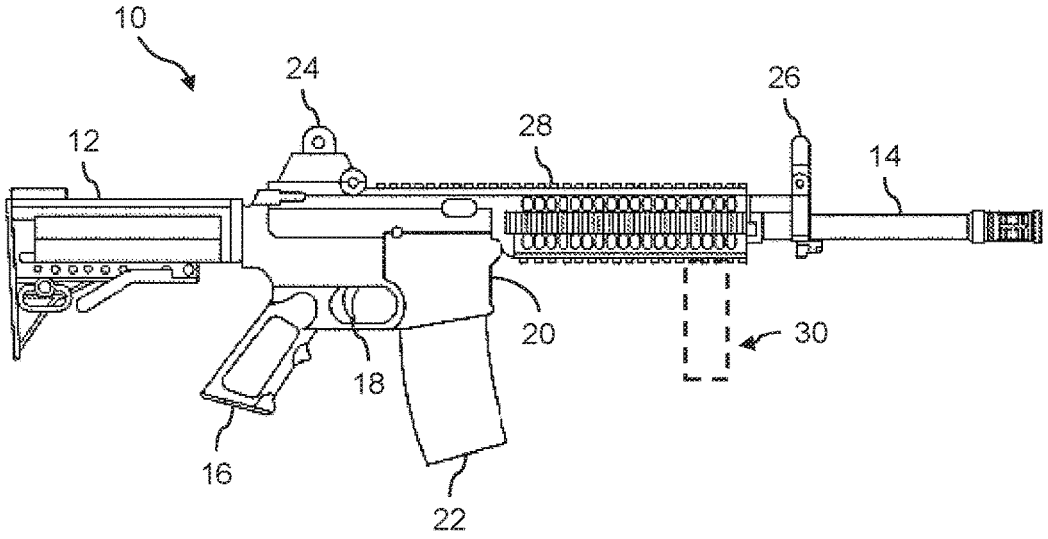
FIG. 1A RELATED ART
FIG. 1A illustrates a side view of an example of a carbine type rifle having a conventional foregrip.

Before discussing embodiments of the axially offset foregrip disclosed herein, reference will be made to a conventional carbine type rifle and foregrip. In this regard, FIG. 1A illustrates a side view of an example of long gun 10, which is a carbine type rifle in this embodiment. The carbine type rifle 10 can be, for example, any conventional AR-15 rifle. The components of the carbine type rifle 10 include, but are not limited to, a stock 12, a barrel 14, a pistol grip 16, a trigger 18, a magazine well 20, a magazine 22, a rear sight 24, a front sight 26, and an accessory mount system 28. The accessory mount system 28 can be any conventional accessory mount system, such as a Picatinny rail, a Weaver rail mount, or a KeyMod system. The Picatinny rail, also referred to as a MIL-STD-1913 rail, STANAG 2324 rail, or tactical rail, is a standardized bracket that provides a standard mounting platform for mounting accessories and attachments to a firearm. Examples of accessories and attachments include lights and lasers. In this example, a conventional foregrip 30 is mounted to a bottom portion of the accessory mount system 28, extending downwardly.

One drawback of this configuration is that the position of the foregrip is not ergonomically correct. For example, using the AR-15 rifle or the M4A1 rifle with a conventional foregrip can cause stress and/or discomfort on the wrist, arm, and/or shoulder, possibly leading to injury. Further, this configuration simply may not be the preferred position of the user. Therefore, new approaches are needed for using a long gun or long rifle.

Figure 1B:
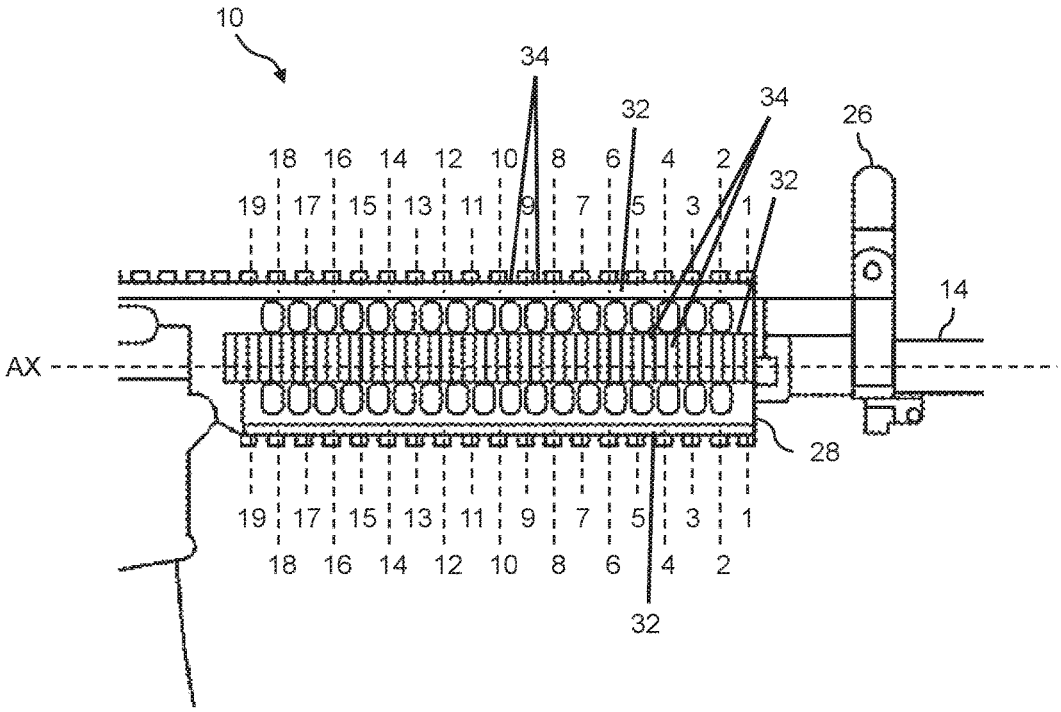
FIG. 1B RELATED ART
FIG. 1B illustrates a side view of a portion of the carbine type rifle of FIG. 1A showing more details of the accessory mount system.

Referring now to FIG. 1B, a side view of a portion of the carbine type rifle 10 of FIG. 1A showing more details of the accessory mount system 28 is illustrated. In this example, the accessory mount system 28 is a Picatinny rail having a plurality of rails 32 disposed along the two sides of the accessory mount system 28, along the top side of the accessory mount system 28, and along the bottom side of the accessory mount system 28. A line of rail features 34 is provided along each rail 32. More details of the rail features 34 of the accessory mount system 28 will be discussed below with reference to FIG. 5. As points of reference, FIG. 1B shows the positions of the rail features 34 along each rail 32 of accessory mount system 28 numbered from (1) to (19), wherein position (1) is the forward most rail feature 34 and position (19) is the rearmost rail feature 34.

Figure 2A:
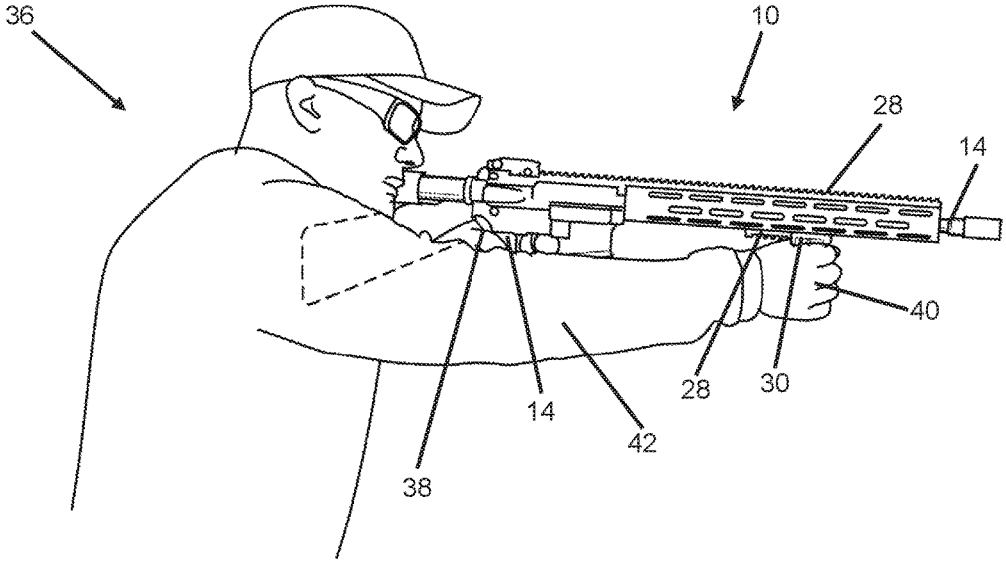
FIG. 2A RELATED ART
FIGS. 2A-2B illustrate side and top views of the carbine type rifle with the conventional foregrip of FIG. 1A in use.
Figure 2B:
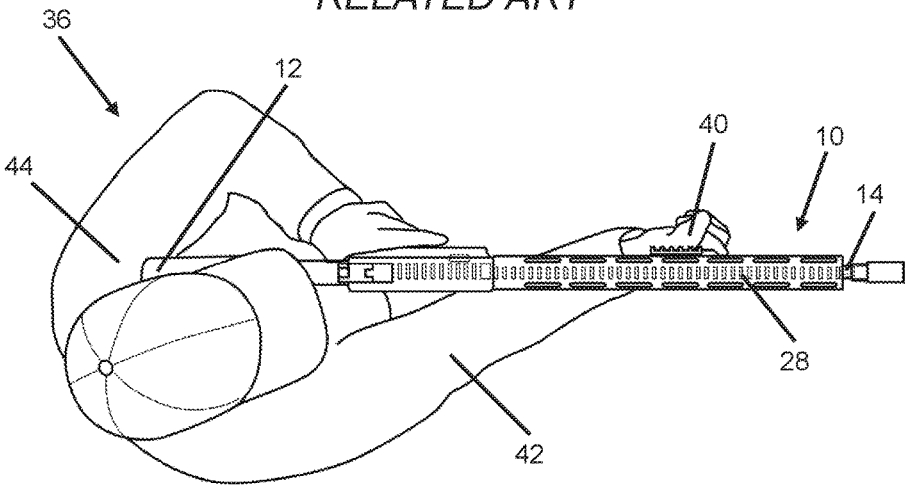
FIG. 2B RELATED ART

As noted above, the conventional foregrip 30 of FIG. 1A extends downwardly from the bottom rail 32 of the accessory mount system 28. However, one drawback of this configuration is that the position of the foregrip 30 is not ergonomically correct. In this regard, FIGS. 2A-2B illustrate side and top views of the carbine type rifle 10 with the conventional foregrip 30 of FIG. 1A in use. A user 36 grasps the pistol grip 16 with his firing hand 38 and grasps the conventional foregrip 30 with his support hand 40 (i.e., "off" hand). However, using a conventional carbine type rifle 10, such as an AR-15 rifle or the M4A1 rifle, with a conventional foregrip 30 can cause stress and/or discomfort to the users' wrists, arm, and/or shoulder, possibly leading to injury. For example, the user's support arm 42 is aligned below and at a horizontal angle with respect to the barrel 14 of the rifle 10 and the firing shoulder 44 of the user 36, which is not optimal for handling the forces associated with holding and aiming the rifle 10, or the recoil from firing the rifle 10. Further, this configuration simply may not be the preferred position of the user.

Figure 3:
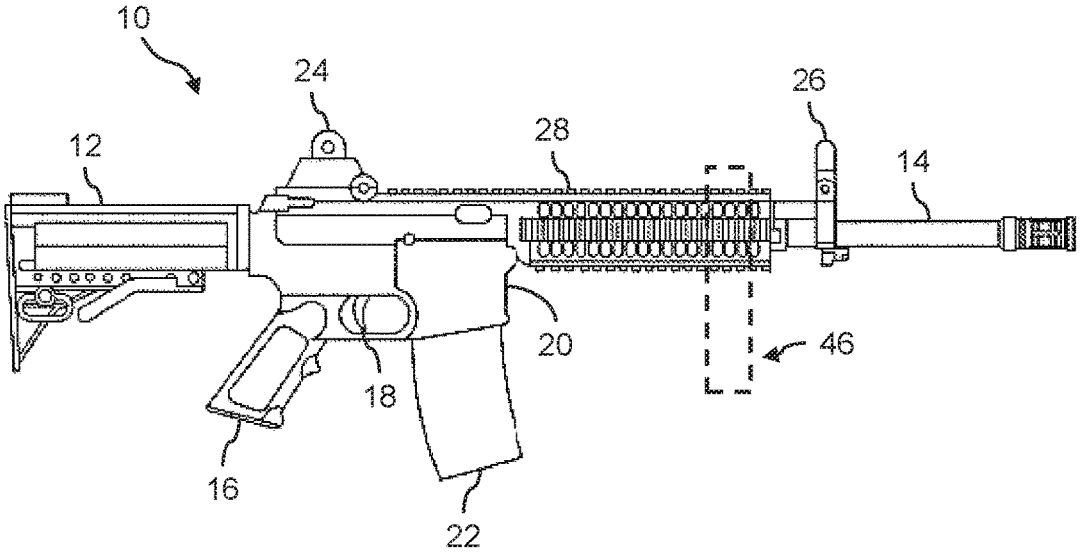
FIG. 3 illustrates a side view of an example of a carbine type rifle having an axially offset foregrip according to an embodiment.

In this regard, referring now to FIG. 3, a side view of an embodiment of the presently disclosed foregrip 46 in relation to a carbine type rifle 10 is disclosed. Similar to FIG. 1A above, the carbine type rifle 10 can be, for example, any conventional AR-15 rifle having similar components, including a stock 12, a barrel 14, a pistol grip 16, a trigger 18, a magazine well 20, a magazine 22, a rear sight 24, a front sight 26, and an accessory mount system 28. In this embodiment, an axially offset foregrip 46 is provided, which can be mounted at any position of the accessory mount system 28. In this and other embodiments, the foregrip 46 may also be referred to as a forward inline stability targeting (FIST) grip. As used herein, the term "inline" means in line with the shoulder support arm of the shooter.

Figure 4A:
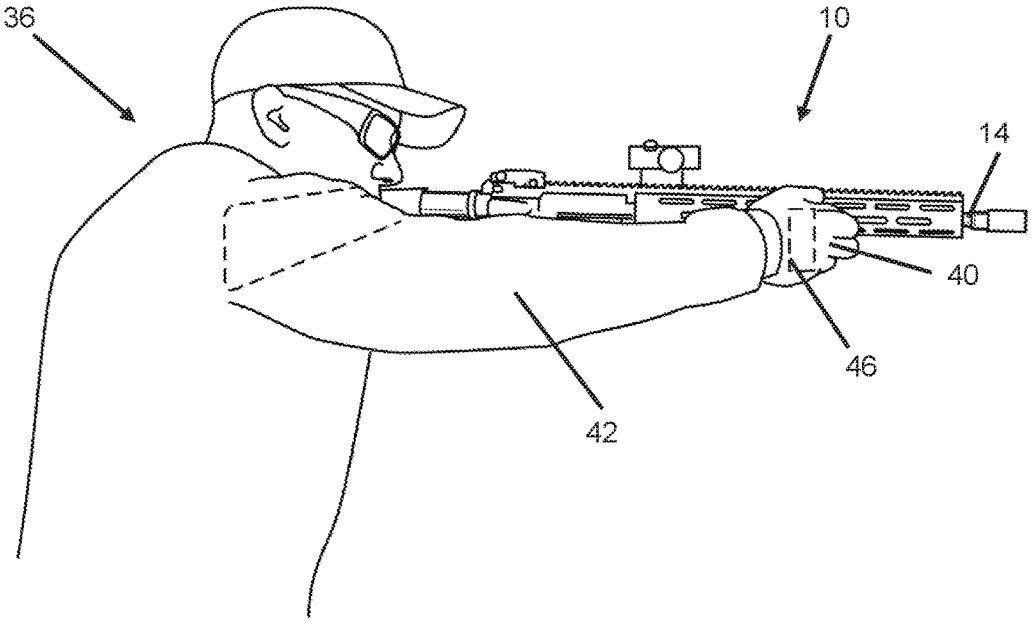
FIGS. 4A-4B illustrate side and top views of the carbine type rifle with the axially offset foregrip of FIG. 3 in use.
Figure 4B:
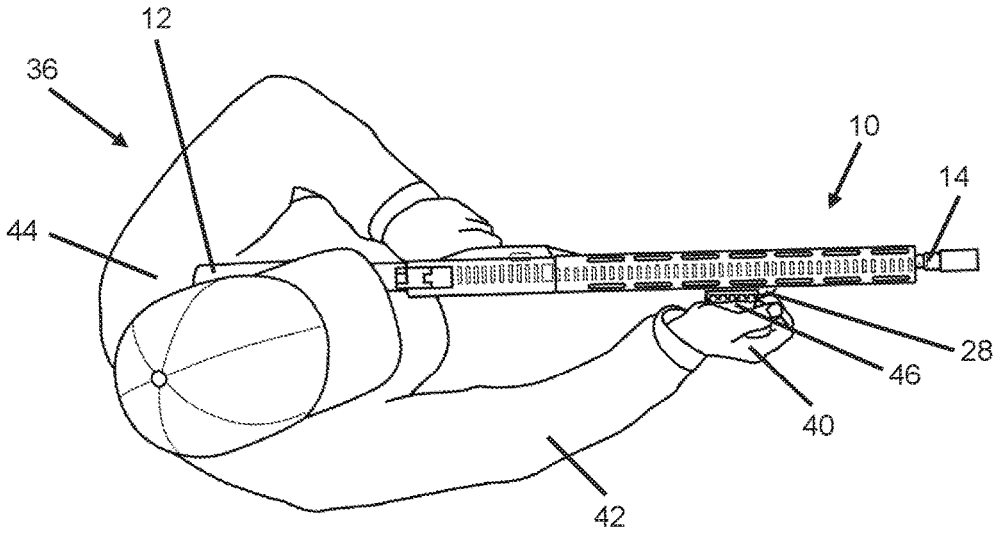

To better illustrate the positioning and orientation of the foregrip 46, FIGS. 4A-4B illustrate side and top views of the carbine type rifle 10 with the foregrip 46 of FIG. 3 in use. In this embodiment, the foregrip 46 is substantially vertical and is horizontally offset from the barrel 14. This permits the user's support hand 40 and support arm 42 to be more aligned with the barrel 14, which results in increased accuracy and comfort for the user 36, and helps in preventing fatigue and injury.

Figure 5:
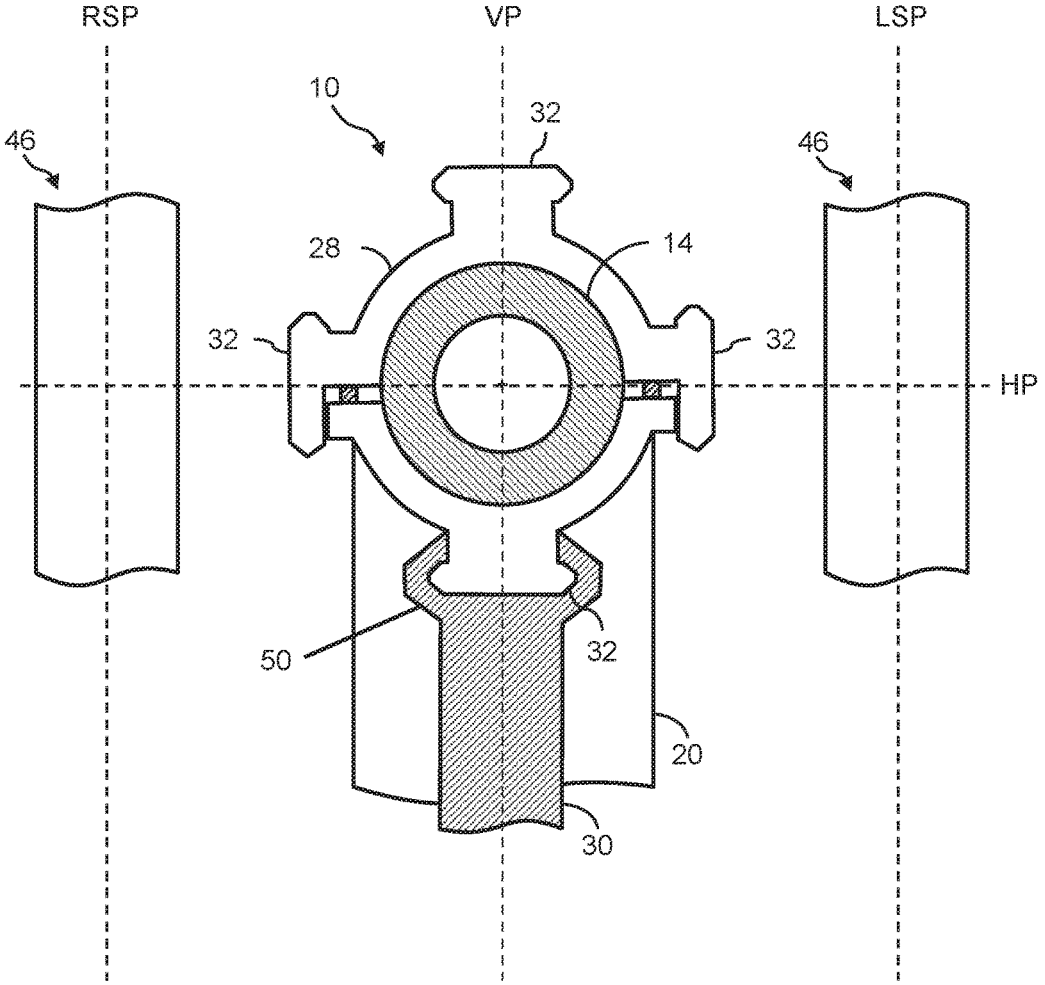
FIG. 5 illustrates a detailed end view of the carbine type rifle and a partial end view of a pair of axially offset foregrips showing more details of the presently disclosed axially offset foregrips in relation to the accessory mount system.

Referring now to FIG. 5, an end view of the carbine type rifle 10 showing more details of the presently disclosed foregrip 46 in relation to the accessory mount system 28 is illustrated. Again, in this example, the accessory mount system 28 is a Picatinny rail. With the carbine type rifle 10 being held in the normal shooting position, the accessory mount system 28 has a top, bottom, and two side rails 32, each having a line of rail features 34. Intersecting at the center of the barrel 14 of the carbine type rifle 10 is a vertical plane VP and a horizontal plane HP. Offset to the right side of the vertical plane VP is a right side plane RSP, wherein the right side plane RSP is substantially parallel to the vertical plane VP. Similarly, offset to the left side of the vertical plane VP is a left side plane LSP, wherein the left side plane LSP is substantially parallel to the vertical plane VP. The distance of the right side plane RSP and the left side plane LSP from the vertical plane VP can vary depending on the design and configuration of the presently disclosed foregrips 46. The distance of the right side plane RSP and the left side plane LSP from the vertical plane VP can be from about 1 inch to about 6 inches in one example, or is about 3 inches in another example.

FIG. 5 shows the grip portion of the foregrips 46 in the right side plane RSP or the left side plane LSP. By comparison, FIG. 3 also shows a conventional foregrip 30 attached to one of the bottom rail features 34 and in the vertical plane VP. The conventional foregrip 30 is not offset from the vertical plane VP causing it not to be ergonomically correct for the user. By contrast, the foregrips 46 are offset from the vertical plane VP, which allows them to be ergonomically correct for the user.

Figure 6A:
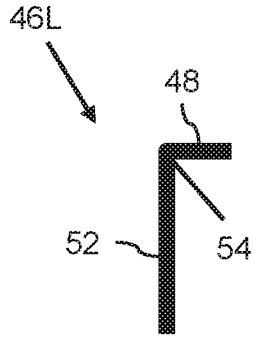
FIGS. 6A-6D illustrate side views of respective L-type, T-type, U-type, and J-type foregrips according to some embodiments.

Referring now to FIGS. 6A-6D, side views of four examples of the presently disclosed foregrips 46 are disclosed. In this regard, FIG. 6A shows an L-type foregrip 46L that comprises a grip portion 52 and a connector portion 48, wherein the connector portion 48 is attached via an L-junction 54 at one end of the grip portion 52. Further, the connector portion 48 comprises one segment.

Figure 6B:
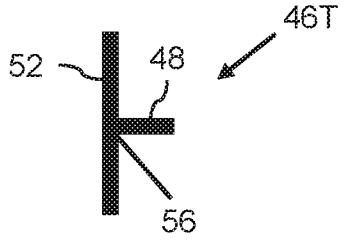

FIG. 6B shows a T-type foregrip 46T that comprises the grip portion 52 and the connector portion 48, wherein the connector portion 48 is attached via a T-junction 56 at about the center of the grip portion 52. Further, the connector portion 48 comprises one segment.

Figure 6C:
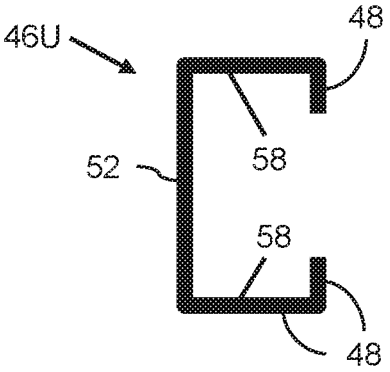

FIG. 6C shows a U-type foregrip 46U that comprises the grip portion 52 and two of the connector portions 48, wherein one connector portion 48 has an extension portion 58 that is attached at one end of the grip portion 52 and another connector portion 48 has a complementary extension portion 58 that is attached at the other end of the grip portion 52.

Figure 6D:
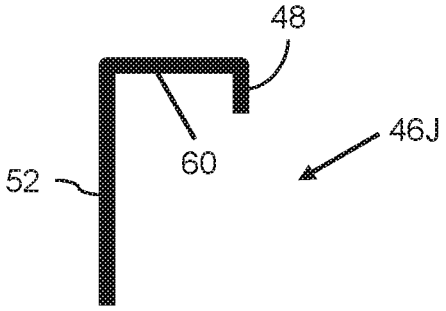

FIG. 6D shows a J-type foregrip 46J that comprises the grip portion 52 and the connector portion 48, wherein the connector portion 48 has an extension portion 60 that is attached at one end of the grip portion 52. Further, the connector portion 48 had an extension portion 60 that is attached at one end of the grip portion 52.

In the L-type foregrip 46L, the T-type foregrip 46T, the U-type foregrip 46U, and the J-type foregrip 46J, fastening hardware 50 (not shown) is provided at the connector portions 48. The fastening hardware 50 is specific to the type of accessory mount system 28 (not shown). For example, the fastening hardware 50 can be Picatinny rail-specific, Weaver rail mount-specific, or KeyMod system-specific. More details of examples of the fastening hardware are shown and described hereinbelow with reference to FIGS. 12-15.

Figure 7A:
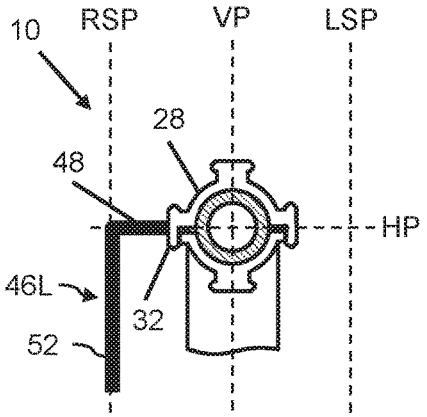
FIGS. 7A-7D illustrate side views of four selectable mounting positions of the L-type foregrip of FIG. 6A.
Figure 7B:
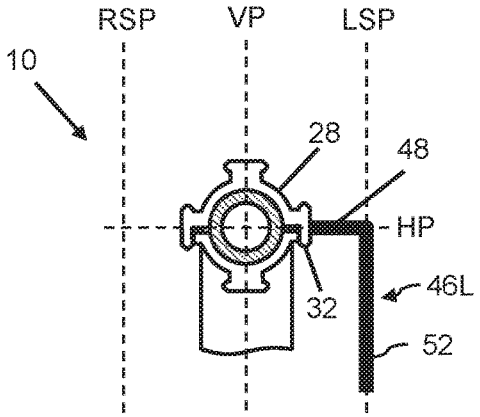
Figure 7C:
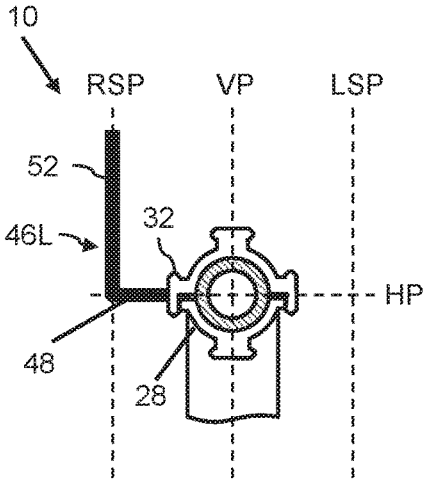
Figure 7D:
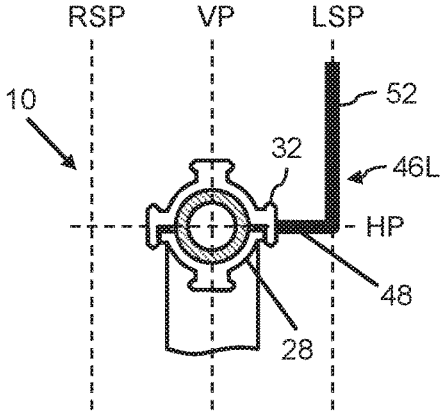

Referring now to FIGS. 7A-10D, various configurations of the various types of foregrips 46 are illustrated. In one example, FIGS. 7A-7D show side views of four mounting positions of the L-type foregrip 46L. In particular, FIG. 7A shows a right side-mounted L-type foregrip 46L with the grip portion 52 oriented downward. FIG. 7B shows a left side-mounted L-type foregrip 46L with the grip portion 52 oriented downward. FIG. 7C shows a right side-mounted L-type foregrip 46L with the grip portion 52 oriented upward. FIG. 7D shows a left side-mounted L-type foregrip 46L with the grip portion 52 oriented upward.

Figure 8A:
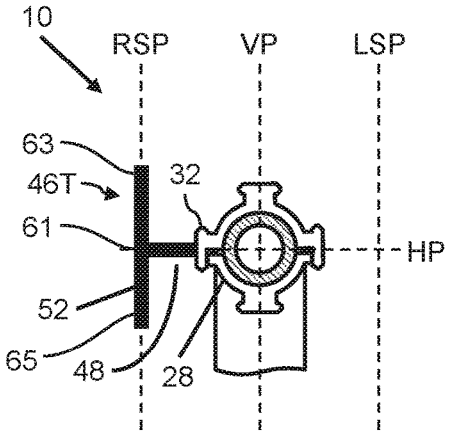
FIGS. 8A-8B illustrate side views of two selectable mounting positions of the T-type foregrip of FIG. 6B.
Figure 8B:
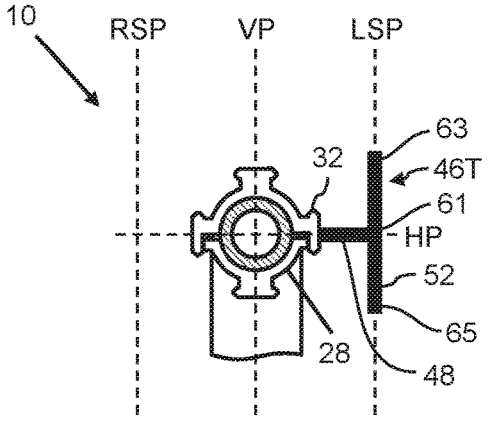

In another example, FIG. 8A and FIG. 8B show side views of two mounting positions of the T-type foregrip 46T. In particular, FIG. 8A shows a right side-mounted T-type foregrip 46T. FIG. 8B shows a left side-mounted T-type foregrip 46T. In these embodiments, it can be seen that the connector portion 48 is connected between a middle portion 61 of the grip portion 52 and the accessory mount system 28 at the fore-end of the rifle 10. A top end 63 of the grip portion 52 is disposed above the middle portion 61 and a bottom end 65 of the grip portion is disposed below the middle portion 61. It can also be seen that the connector portion 48 in these embodiments has a horizontal axis that extends substantially horizontally in the horizontal plane HP in a direction that is substantially perpendicular to a vertical grip plane, i.e., the right side plane RSP in FIG. 8A or the left side plane LSP in FIG. 8B. In these embodiments, it can be seen that the middle portion 61 is configured to be grasped by a hand of a user about the grip axis of the grip portion 52 so that the horizontal axis of the connector portion 48 passes through the hand of the user. This in turn horizontally aligns the user's grip with the center of the fore-end of the rifle 10, which leads to an increase in stability, accuracy, and comfort for the user.

Figure 9A:
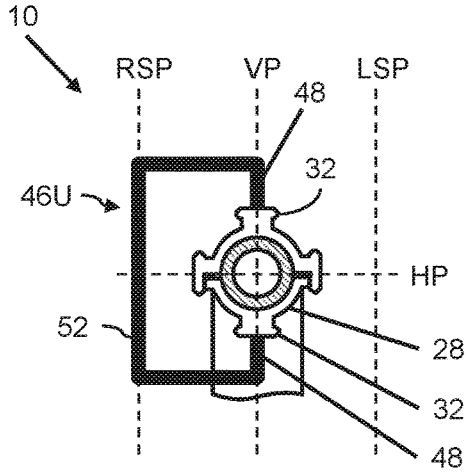
FIGS. 9A-9B illustrate side views of two selectable positions of the U-type foregrip of FIG. 6C.
Figure 9B:
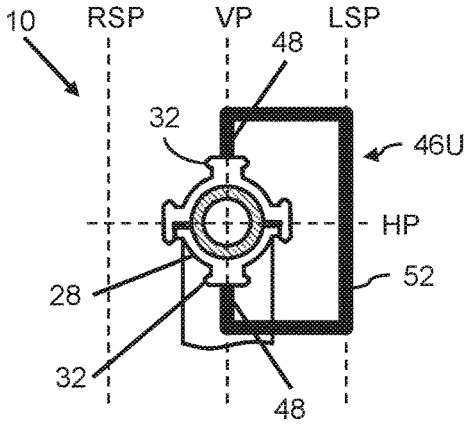

In yet another example, FIG. 9A and FIG. 9B show side views of two mounting positions of the U-type foregrip 46U. In particular, FIG. 9A shows a right side-mounted U-type foregrip 46U. FIG. 9B shows a left side-mounted U-type foregrip 46U.

Figure 10A:
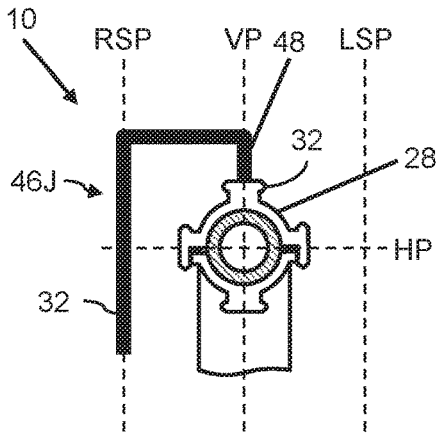
FIGS. 10A-10D illustrate side views of four selectable mounting positions of the J-type foregrip of FIG. 6D.
Figure 10B:
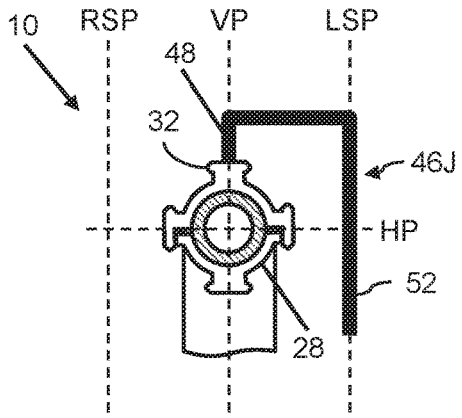
Figure 10C:
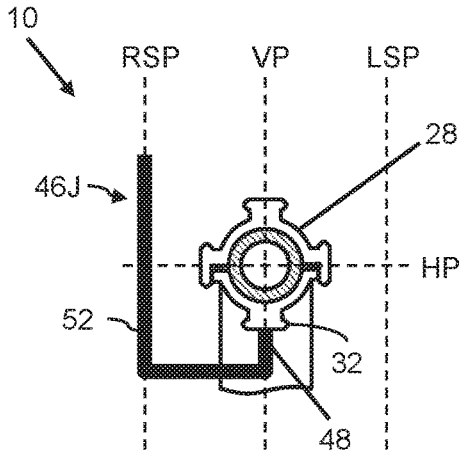
Figure 10D:
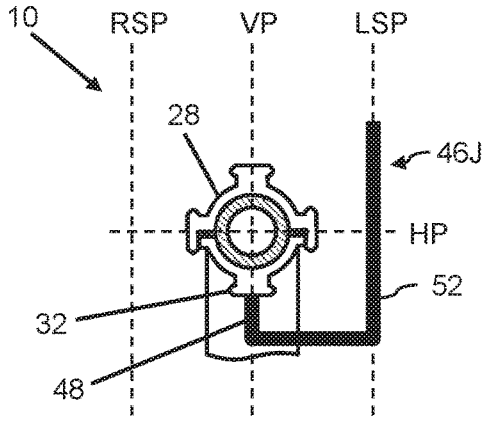

In still another example, FIGS. 10A-10D show side views of four mounting positions of the J-type foregrip 46J. In particular, FIG. 10A shows a right side-mounted J-type foregrip 46J with the grip portion 52 oriented downward. FIG. 10B shows a left side-mounted J-type foregrip 46J with the grip portion 52 oriented downward. FIG. 10C shows a right side-mounted J-type foregrip 46J with the grip portion 52 oriented upward. FIG. 10D shows a left side-mounted J-type foregrip 46J with the grip portion 52 oriented upward.

Figure 11A:
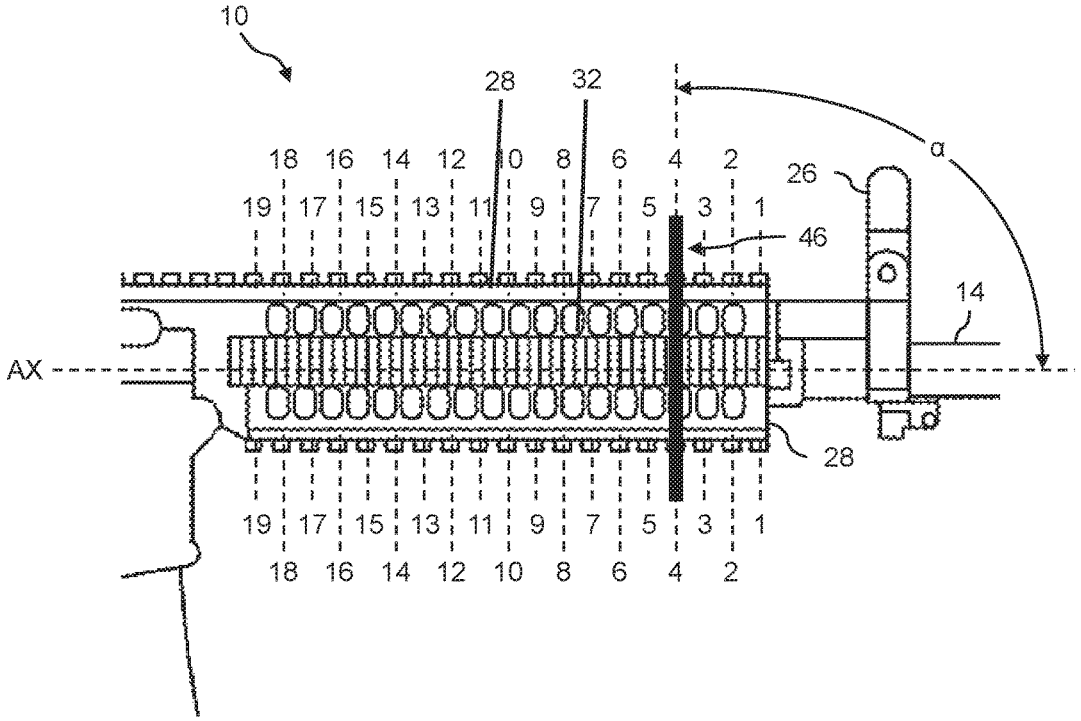
FIGS. 11A-11C illustrate side views of three selectable mounting angles of the axially offset foregrip with respect to a longitudinal axis of a barrel of the rifle.
Figure 11B:
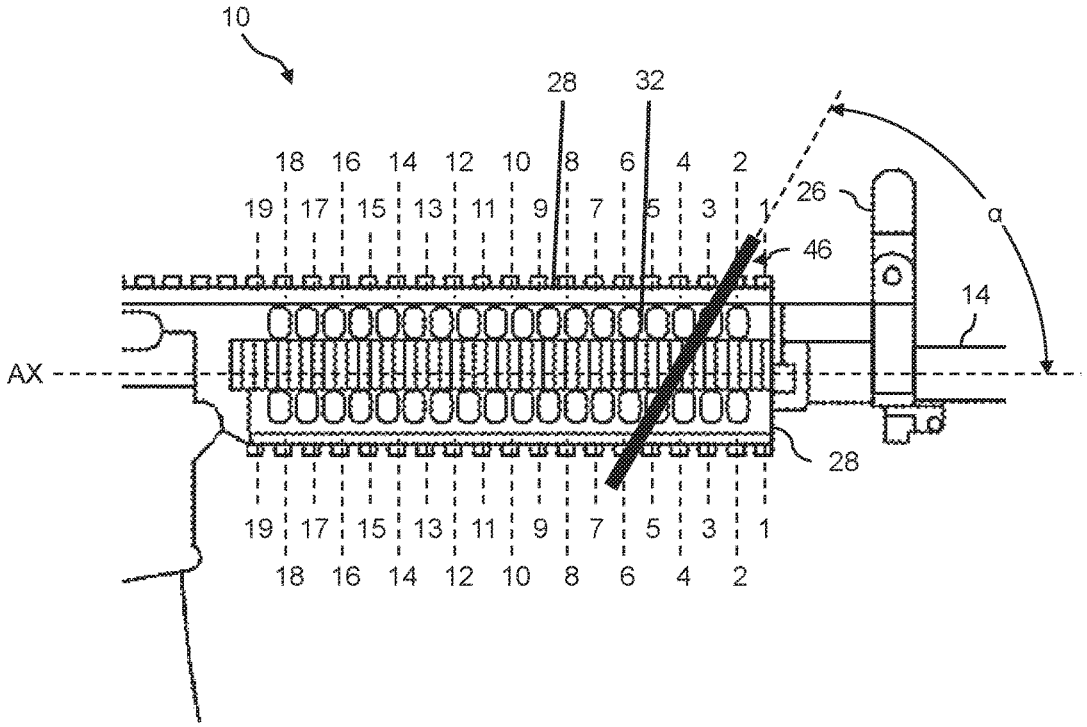
Figure 11C:
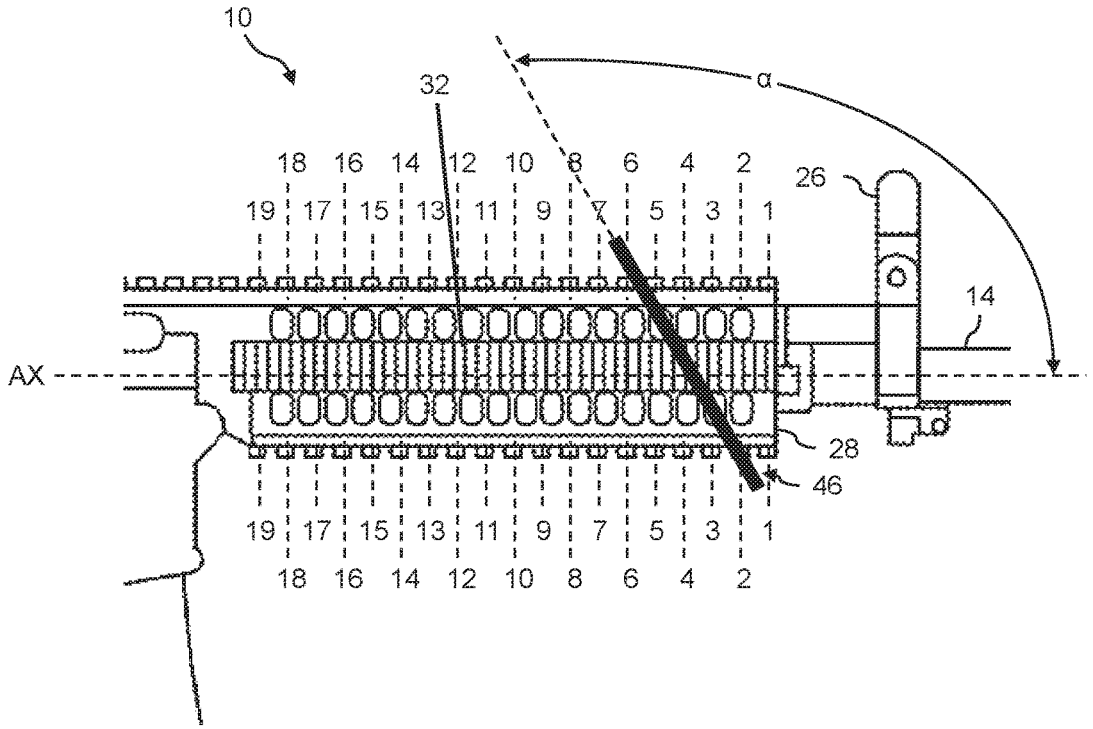

Referring now to FIGS. 11A-11C, side views of three mounting angles of the presently disclosed foregrip 46 are illustrated. If the barrel 14 of the carbine type rifle 10 has a longitudinal axis AX, a grip axis of grip portion 52 of the presently disclosed foregrip 46 can be provided at different angles with respect to the longitudinal axis AX. In one example, FIG. 11A shows the grip axis of the foregrip 46 at an angle $\alpha$ of about 90 degrees with respect to the longitudinal axis AX. By way of example, the angle $\alpha$ of the U-type foregrip 46U can be set to about 90 degrees by attaching the first connector portion 48 at position (4) of the top rail 32 and the second connector portion 48 at position (4) of the bottom rail 32 of the accessory mount system 28.

In another example, FIG. 11B shows the grip axis of the foregrip 46 at an angle $\alpha$ of about 60 degrees with respect to the longitudinal axis AX. By way of example, the angle $\alpha$ of the U-type foregrip 46U can be set to about 30 degrees by attaching the first connector portion 48 at position (2) of the top rail 32 and the second connector portion 48 at position (6) of the bottom rail 32 of the accessory mount system 28.

In yet another example, FIG. 11C shows the grip portion 52 of the foregrips 46 at an angle $\alpha$ of about 120 degrees with respect to the longitudinal axis AX. By way of example, the angle $\alpha$ of the U-type foregrip 46U can be set to about 120 degrees by attaching the first connector portion 48 at position (6) of the top rail 32 and the second connector portion 48 at position (2) of the bottom rail 32 of the accessory mount system 28. It should be understood that while angle $\alpha$ can be between 60 and 90 degrees or between 90 and 120 degrees in some embodiments, angle $\alpha$ can be any angle, as desired.

Referring again to FIGS. 11A-11C, the angle $\alpha$ of any types of foregrips 46 can be fixed or adjustable. For example, angle adjustment mechanisms can be built into the grip portion 52 and/or the connector portion 48 of the foregrips 46 to allow selective rotation and/or positioning of the grip portion 52 with respect to the connector portion 48.

Figure 12:
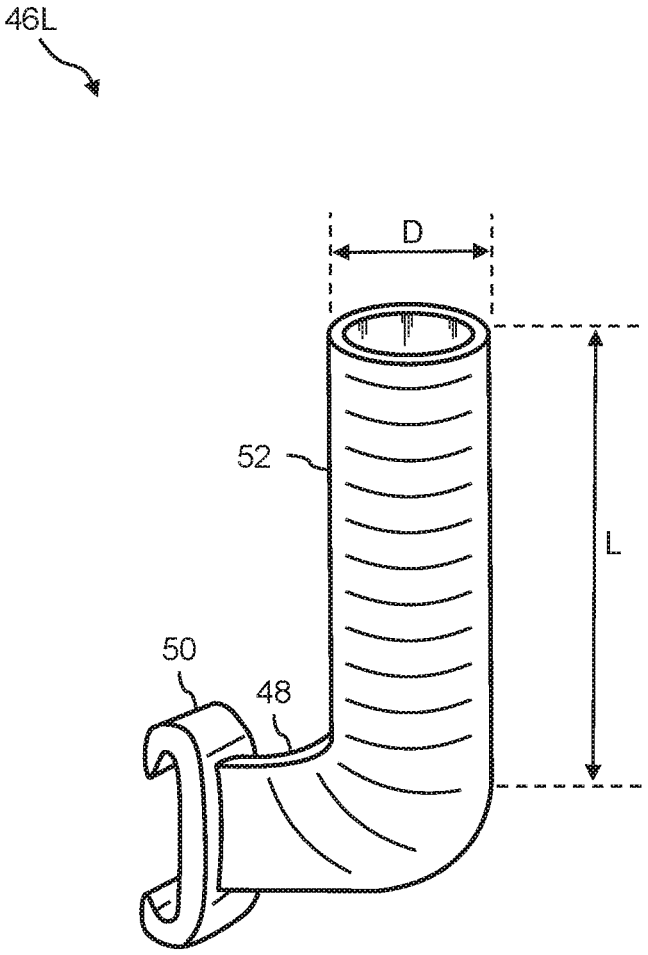
FIG. 12 illustrates a perspective view of an example of the L-type foregrip according to an embodiment.

Referring now to FIG. 12, a perspective view of an example of a specific instantiation of the L-type foregrip 46L is disclosed. In this example, the L-type foregrip 46L comprises a barrel-shaped grip portion 52. The connector portion 48 is integrated into one end of the barrel-shaped grip portion 52 and is at about a 90 degree angle. Certain fastening hardware 50 is mechanically coupled to the connector portion 48. In particular, the connector portion 48 is a single segment that is arranged between one end of the barrel-shaped grip portion 52 and the fastening hardware 50. The fastening hardware 50 in this embodiment is configured to be coupled to a rail 32 of the Picatinny rail system disclosed above, and is illustrated in simplified form herein, but it should be understood that the fastening hardware 50 can be any hardware and can be made compatible with other types of accessory mount systems 28.

Figure 13:
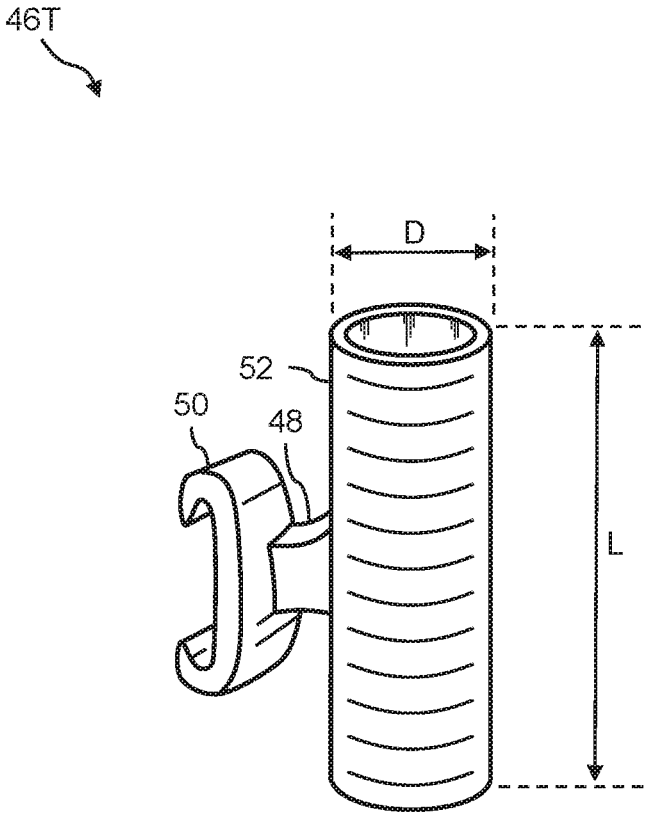
FIG. 13 illustrates a perspective view of an example of the T-type foregrip grip according to an embodiment.

Referring now to FIG. 13, a perspective view of an example of a specific instantiation of the T-type foregrip 46T is disclosed. In this example, the T-type foregrip 46T comprises a barrel-shaped grip portion 52. The connector portion 48 is integrated into the center portion of the barrel-shaped grip portion 52 and is at about a 90 degree angle.

Certain fastening hardware 50 is mechanically coupled to the connector portion 48. In particular, the connector portion 48 is a single segment that is arranged between the center portion of the barrel-shaped grip portion 52 and the fastening hardware 50.

Figure 14:
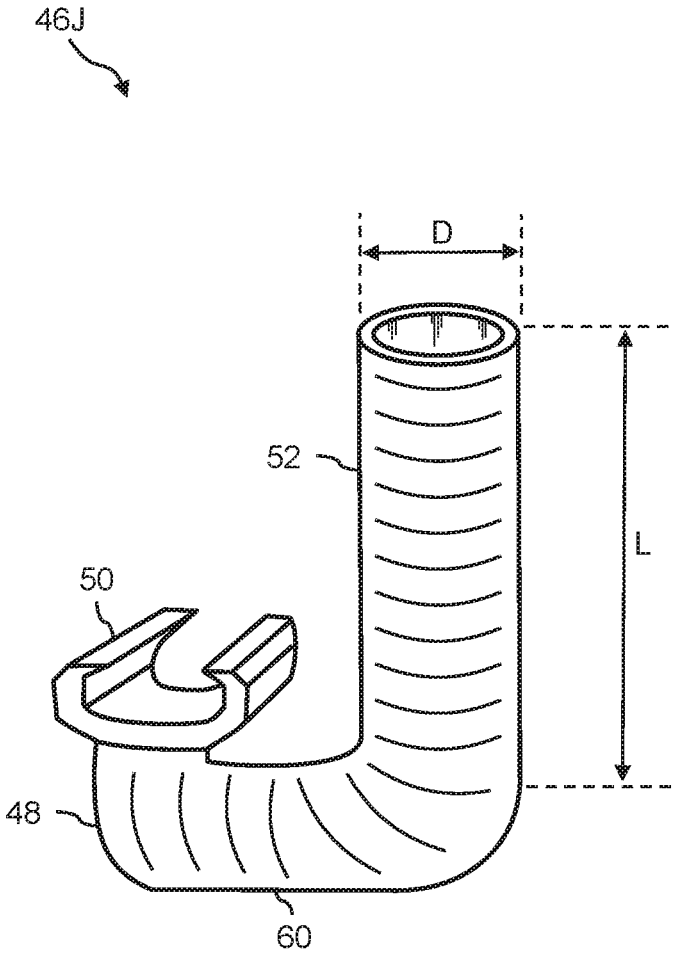
FIG. 14 illustrates a perspective view of an example of the J-type foregrip according to an embodiment.

Referring now to FIG. 14, a perspective view of an example of a specific instantiation of the J-type foregrip 46J is disclosed. In this example, the J-type foregrip 46J comprises a barrel-shaped grip portion 52. The connector portion 48 is integrated into one end of the barrel-shaped grip portion 52 and is at about a 90 degree angle. Certain fastening hardware 50 is mechanically coupled to the connector portion 48. In particular, the connector portion 48 includes an extension portion 60 arranged between one end of the barrel-shaped grip portion 52 and the fastening hardware 50. Again by way of example, the fastening hardware 50 is Picatinny rail-specific and shown in simplified form.

In the examples shown in FIGS. 12-14, the barrel-shaped grip portion 52 has a length L that can be, for example, about 4 inches and a diameter D that can be, for example, about 1.5 inches. However, the length L and the diameter D can vary. The T-type foregrip 46T, the L-type foregrip 46L, the J-type foregrip 46J, and the U-type foregrip 46U can be formed of any rigid, strong, and lightweight materials, such as molded plastic, metal (e.g., aluminum), and any combinations thereof. Further, the barrel-shaped grip portions 52 of the foregrips 46 shown in FIGS. 12-14 can be hollow or solid.

In some embodiments, the foregrip 46 and a portion of the fore-end of the long gun 10 can be formed as a unitary component, such as with the barrel 14, the accessory mount system 28, a forestock (not shown) or another component. For example, the foregrip 46 could be molded together with a plastic forestock (not shown) that is secured around the barrel 14. Alternatively, the foregrip 46 could be welded directly to the barrel 14, the accessory mount system 28, or to another component at the fore-end of the long gun 10. One advantage of forming the foregrip 46 as a unitary component with a portion of the fore-end of the long gun 10 is that the foregrip 46 would be attached more securely to the main body of the long gun 10, thereby helping to increase stability and accuracy during firing of the long gun 10.

Figure 15:
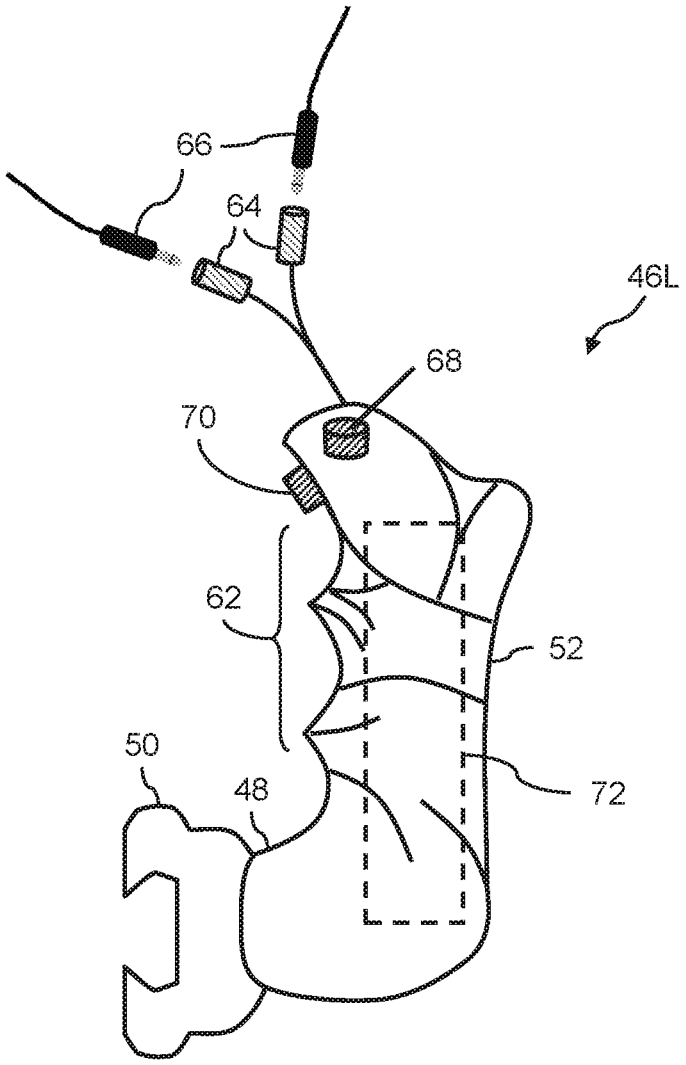
FIG. 15 illustrates a perspective view of another example of the L-type foregrip according to an embodiment that comprises additional features.

While FIGS. 12-14 show simplified designs of the foregrips 46, other features can be integrated into the presently disclosed foregrips 46. For example, FIG. 15 shows a perspective view of an example of a specific example of the L-type foregrip 46L that comprises additional features. In this example, the grip portion 52 of the L-type foregrip 46L is a contoured grip that comprises finger/hand contours 62 for improved comfort and control. The grip portion 52 may include flexible materials for improved comfort and grip, for example. Further, the grip portion 52 in this embodiment comprises one or more ports 64 for connecting to other accessories. For example, the grip portion 52 may include two ports 64 for connecting to conventional headphone jack connectors 66, e.g., ⅛-inch (3.5 mm) or 3/32-inch (2.5 mm) jacks. In one example, the two ports 64 are electrically connected to two respective pushbuttons 68, 70 that are integrated into the grip portion 52. The two pushbuttons 68, 70 are coupled to respective momentary switches in the grip portion 52. The pushbuttons 68, 70 are used to control any devices connected to the ports 64. In one example, one pushbutton 68 can control a light while the other pushbutton 70 independently controls a laser, such as for a laser sight. Other examples of accessories that can be controlled by pushbuttons 68, 70 include a camera, microphone, or other accessories configured to be mounted to the accessory mount system 28.

Grooves, slots, or notches can be provided inside the hollow grip portion 52 for securing the wires, ports 64, and connectors 66 to safely tuck them out of the way when using the L-type foregrip 46L. Further, the grip portion 52 can comprise a storage compartment 72. In one example, spare batteries can be stored in the storage compartment 72. Snap-fitted covers can be provided at any location for accessing the inside of the hollow grip portion 52.

Figure 16A:
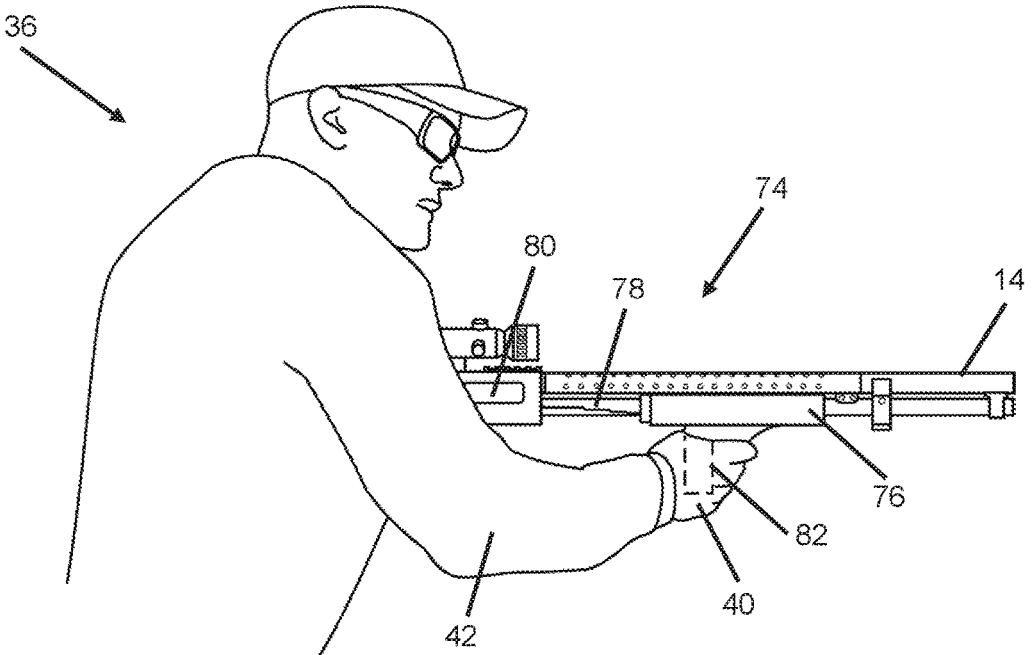
FIG. 16A RELATED ART
FIGS. 16A-16B illustrate side and top views of a conventional pump-action shotgun.
Figure 16B:
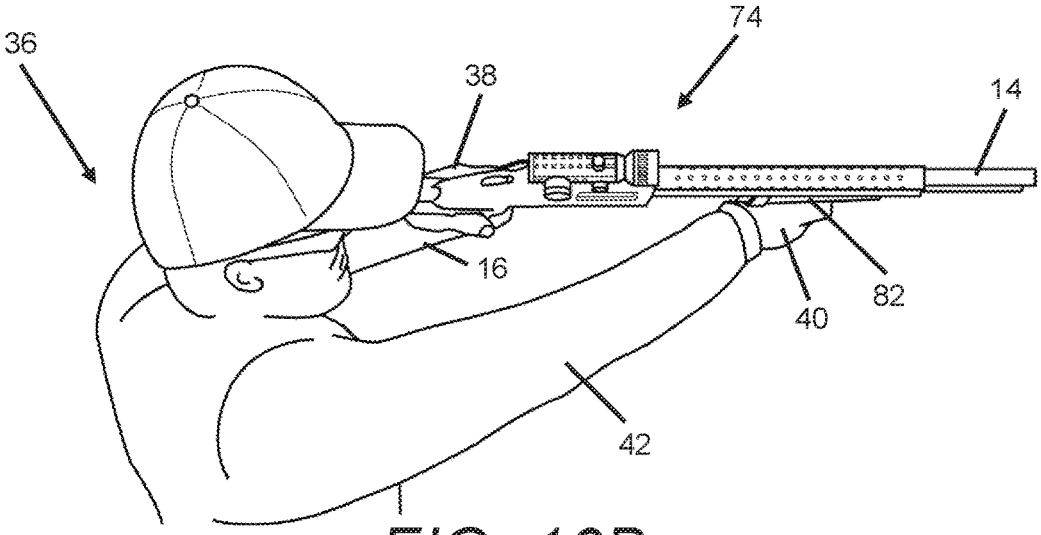
FIG. 16B RELATED ART

The above embodiments are used with a carbine type rifle, but features of these embodiments may be applied to other types of long guns as well. In this regard, FIGS. 16A-16B illustrate side and top views of a conventional pump-action shotgun 74 in normal use. The shotgun 74 includes a barrel 14 defining a longitudinal axis similar to rifle 10 above. The shotgun 74 also includes a forestock 76 movably mounted around magazine 78. Pumping the forestock 76 rearward along the magazine 78 ejects a spent round from ejection port 80 and moving the forestock 76 back to a forward position chambers a new round from the magazine 78. In this embodiment, a conventional foregrip 82 is fixedly attached to the forestock 76 and is configured to allow a user to perform the pump-action of the forestock 76 using the foregrip 82. This arrangement has similar drawbacks to the conventional foregrip 30 used with the rifle 10 above, however, and has additional drawbacks as well. For example, in addition to causing stress and/or discomfort on the wrist, arm, and/or shoulder, the angle of the support arm 42 of the user 36 can be awkward and inefficient for performing the pump action of the foregrip 82. Therefore, as with the rifle 10 above, new approaches are needed.

Figure 17A:
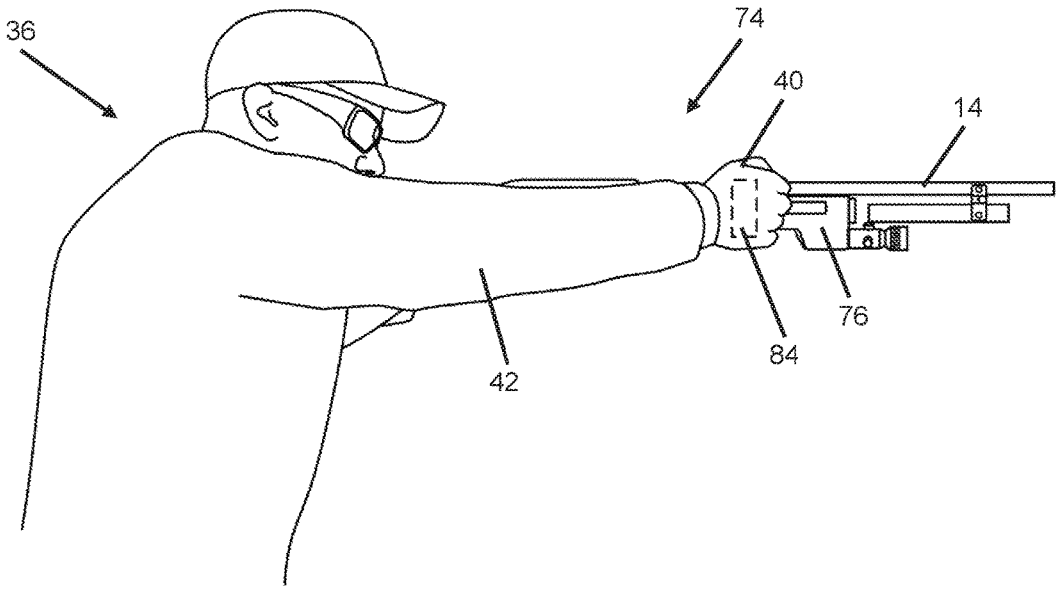
FIGS. 17A-17B illustrate side and top views of a pump-action shotgun with an axially offset foregrip fixed to the forestock according to an embodiment.
Figure 17B:
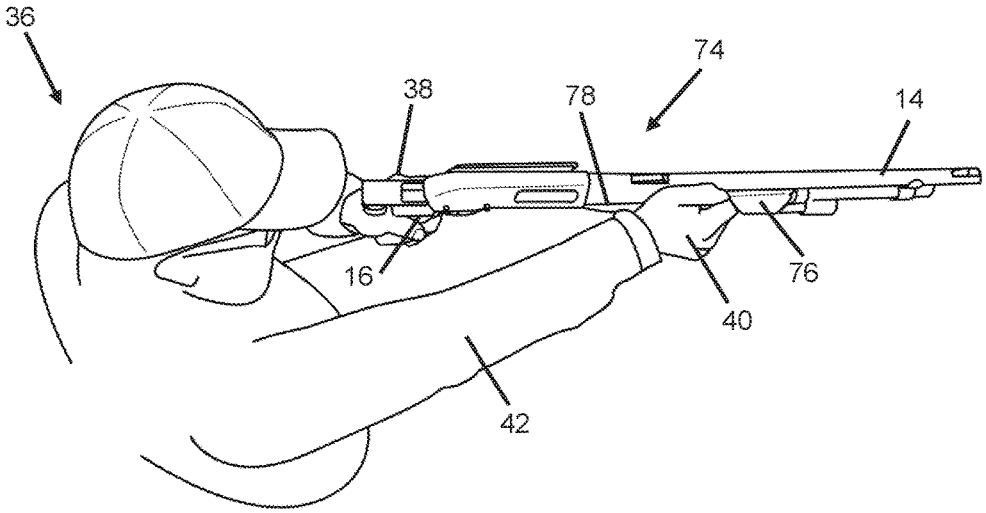

In this regard, FIGS. 17A-17B illustrate side and top views of a pump-action shotgun 74 with an axially offset foregrip 84 fixed to the forestock 76 according to an embodiment. It should be understood that any of the features described above with respect to foregrip 46 may be used with the foregrip 84. In this embodiment, the foregrip 84 is substantially vertical and is horizontally offset from the barrel 14. As with the foregrip 46 above, this arrangement permits the user's support hand 40 and support arm 42 to be more aligned with the barrel 14, which results in increased accuracy and comfort for the user 36, and helps in preventing fatigue and injury. When used with the shotgun 74, this arrangement has the additional benefit of providing improved pump action for the forestock 76 of the shotgun 74 because of the closer alignment between the support arm 42 of the user 36 and the barrel 14 of the shotgun 74.

It should also be understood that other arrangements are contemplated. For example, while the above example relates to a pump-action shotgun 74, it is also possible to use the above-disclosed foregrips 46, 84 with a semi-automatic shotgun (not shown), which may have a forestock 76 that is fixed with respect to the barrel 14. In some embodiments, the foregrip 84 and the forestock 76 or other components can be formed as unitary components, for example by molding or welding. One advantage of forming the foregrip 84 as a unitary component with the forestock 76 is that the forestock 76 would better able to handle and absorb the shear and twisting forces that can result from using a horizontally offset foregrip 84 with a pump action shotgun 74, as well as helping to increase stability and accuracy.

Figure 18:
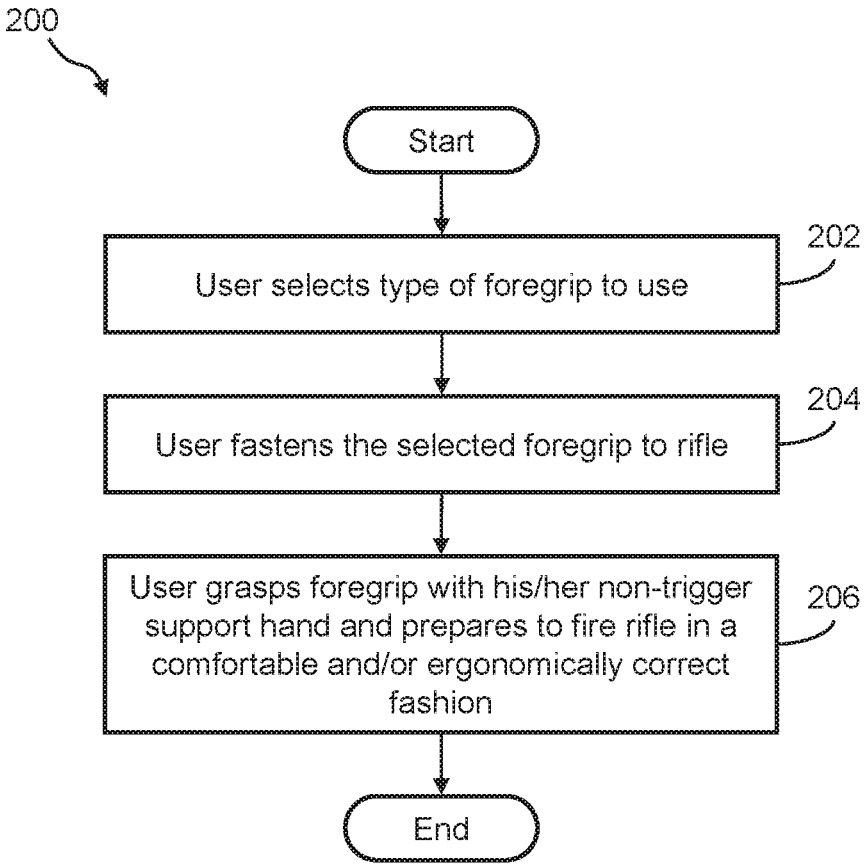
FIG. 18 illustrates a flowchart diagram of an example of a method of using the presently disclosed axially offset foregrip according to an embodiment.

Referring now to FIG. 18 a flow diagram of an example of a method 200 of using the presently disclosed foregrips 46 is illustrated. The method 200 may include, but is not limited to, the following steps.

At block 202, the user selects the desired type of foregrip 46. For example, the user selects the L-type foregrip 46L, the T-type foregrip 46T, the U-type foregrip 46U, or the J-type foregrip 46J. By way of example, the user selects the L-type foregrip 46L shown in FIG. 12.

At block 204, the user fastens the selected foregrip 46 to the rifle, such as rifle 10. For example, the user fastens the selected L-type foregrip 46L, T-type foregrip 46T, U-type foregrip 46U, or J-type foregrip 46J to the carbine type rifle 10. Continuing the example, the user fastens the L-type foregrip 46L shown in FIG. 12 to the accessory mount system 28 of the carbine type rifle 10. In this example, if the user is a right handed shooter, the user attaches the fastening hardware 50 to one of the left side rail features 34 of the accessory mount system 28, wherein the user may orient the grip portion 52 upward or downward as desired in the left side plane LSP. By contrast, if the user is a left handed shooter, the user attaches the fastening hardware 50 to one of the right side rail features 34 of the accessory mount system 28, wherein the user may orient the grip portion 52 upward or downward as desired in the right side plane RSP.

At block 206, the user grasps the grip portion 52 of the foregrip 46 with his/her non-trigger support hand and prepares to fire the rifle in a comfortable and/or ergonomically correct fashion. For example, the user grasps the grip portion 52 of the L-type foregrip 46L shown in FIG. 12 with his/her non-trigger hand and prepares to fire the carbine type rifle 10 in a comfortable and/or ergonomically correct fashion.

Continuing the example, if the user is a right handed shooter, the user grasps the grip portion 52 of the L-type foregrip 46L with his/her left hand and prepares to fire the carbine type rifle 10. By contrast, if the user is a left handed shooter, the user grasps the grip portion 52 of the L-type foregrip 46L with his/her right hand and prepares to fire the carbine type rifle 10.

In this step, because the grip portion 52 of the L-type foregrip 46L is offset to the left side or right side of the vertical plane VP of the barrel 14 and not in line with the rear grip 16, its position is ergonomically correct. As a result, stress and/or discomfort on the wrist, arm, and/or shoulder of the user can be reduced, or eliminated, compared with using conventional foregrips such as foregrip 30.

Figure 19:
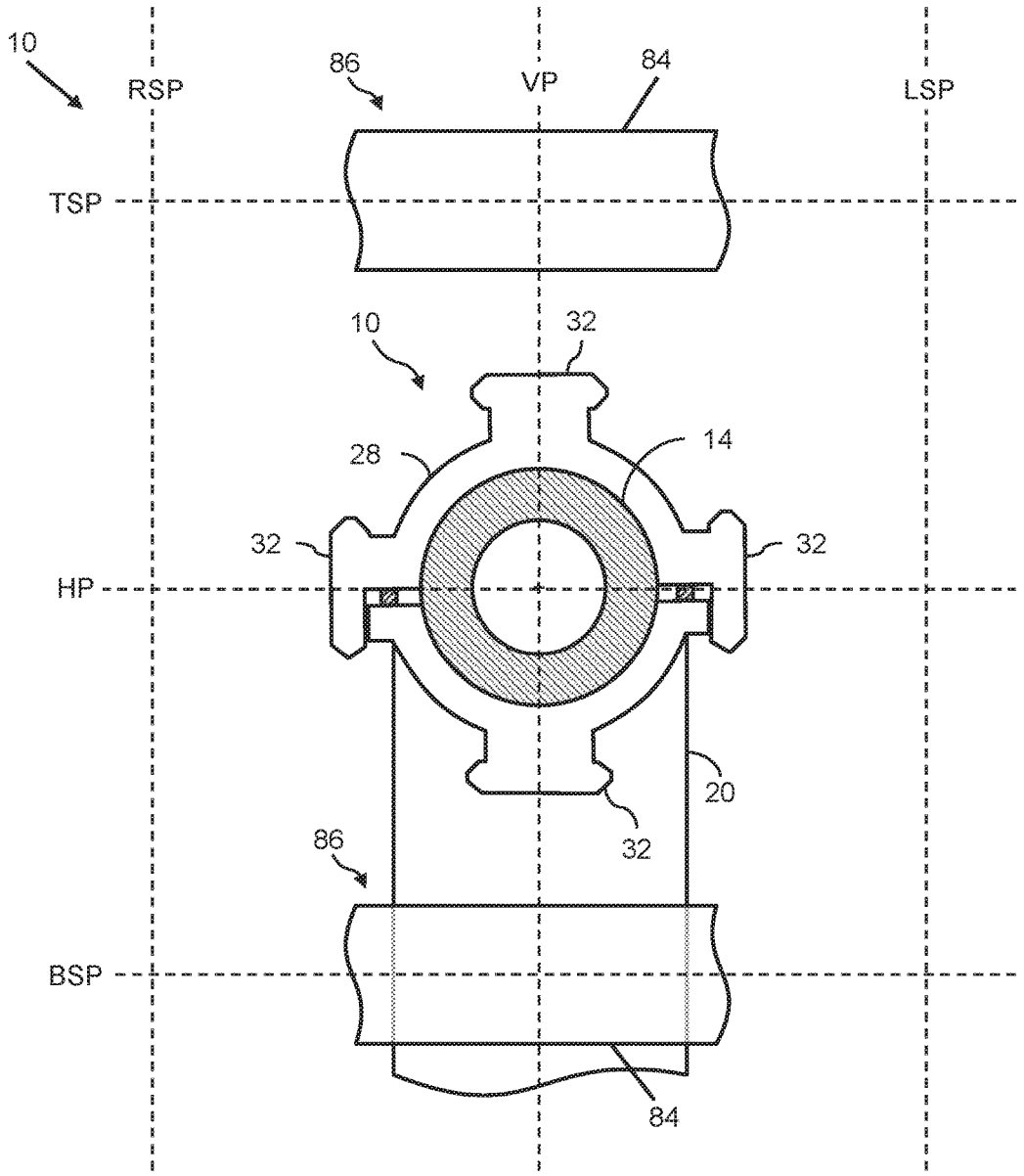
FIG. 19 illustrates a detailed end view of the carbine type rifle and a partial end view of a pair of axially offset foregrips according to an alternative embodiment.

It should be understood that other types of arrangements and orientations for the disclosed foregrips, including foregrips 46, 82, are contemplated. Referring now to FIG. 19, an end view of the carbine type rifle 10 shows different configurations for other types of foregrips 86 in relation to the accessory mount system 28. In addition to the vertical plane VP, the horizontal plane HP, the right side plane RSP, and the left side plane LSP, FIG. 19 shows a top side plane TSP and a bottom side plane BSP. In particular, the top side plane TSP is offset to the top side of the horizontal plane HP, wherein the top side plane TSP is substantially parallel to the horizontal plane HP. Similarly, the bottom side plane BSP is offset to the bottom side of the horizontal plane HP, wherein the bottom side plane BSP is substantially parallel to the horizontal plane HP. FIG. 19 shows the grip portions 84 of the foregrips 86 in the top side plane TSP or the bottom side plane BSP.

The distance of the top side plane TSP and the bottom side plane BSP from the horizontal plane HP can vary depending on the design and configuration of the presently disclosed foregrips 86. The distance of the top side plane TSP and the bottom side plane BSP from the horizontal plane HP can be from about 1 inch to about 6 inches in one example, or about 3 inches in another example.

Figure 20A:
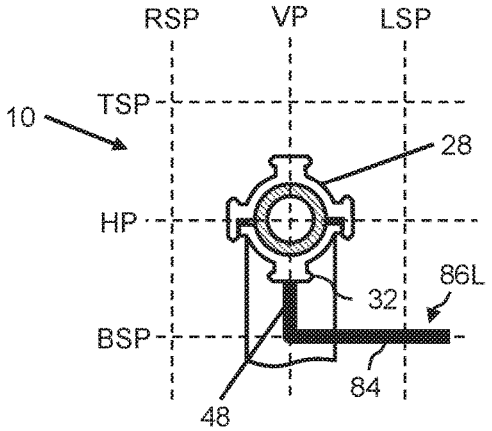
FIGS. 20A-20D illustrate side views of examples of respective L-type, T-type, U-type, and J-type foregrips in alternative configurations according to some embodiments.

Referring now to FIGS. 20A-20D, side views of examples of certain foregrips 86 in relation to the accessory mount system 28 are illustrated, according to the configurations shown in FIG. 19. In particular, FIG. 20A shows a bottom side-mounted L-type foregrip 86L that is connected to one of the bottom rail features 34 and with the grip portion 84 oriented toward the left in the bottom side plane BSP.

Figure 20B:
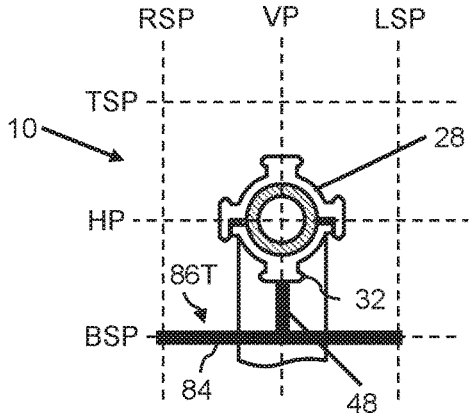
Figure 20C:
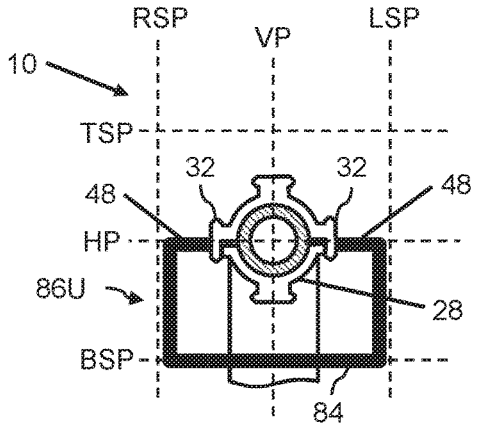
Figure 20D:
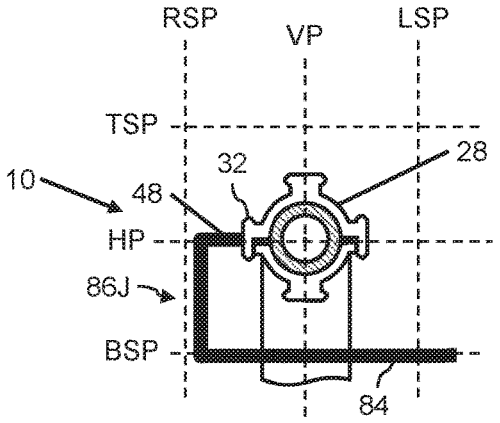

FIG. 20B shows a bottom side-mounted T-type foregrip 86T that is connected to one of the bottom rail features 34 and with the grip portion 84 in the bottom side plane BSP. FIG. 20C shows a bottom side-mounted U-type foregrip 86U that is connected to a right side rail feature 34 and a left side rail feature 34 and with the grip portion 84 in the bottom side plane BSP. FIG. 20D shows a bottom side-mounted J-type foregrip 86J that is connected to one of the right side rail features 34 and with the grip portion 84 oriented toward the left in the bottom side plane BSP. While FIGS. 20A-20D show only bottom sidemounted foregrips 86, the foregrips 86 can be top side-mounted in similar fashion.

Figure 21A:
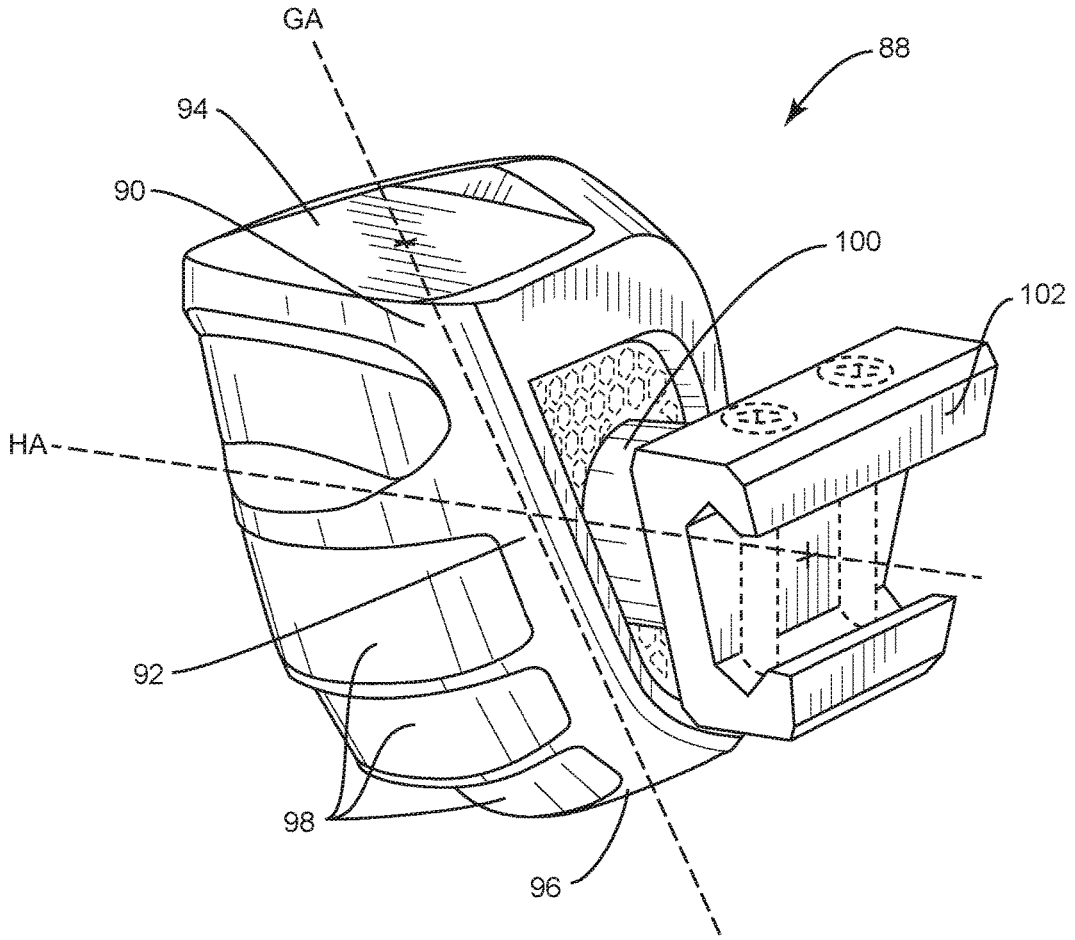
FIGS. 21A-21G illustrate a foregrip including a contoured grip according to another embodiment.
Figure 21B:
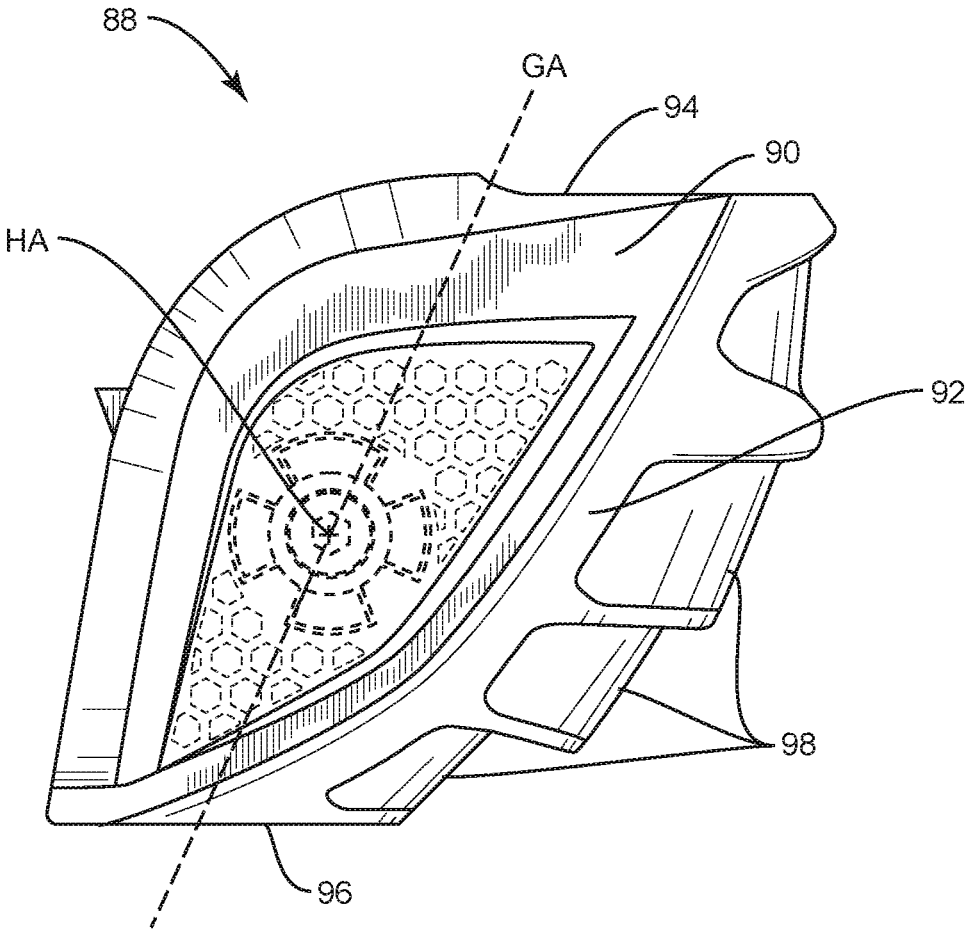
Figure 21C:
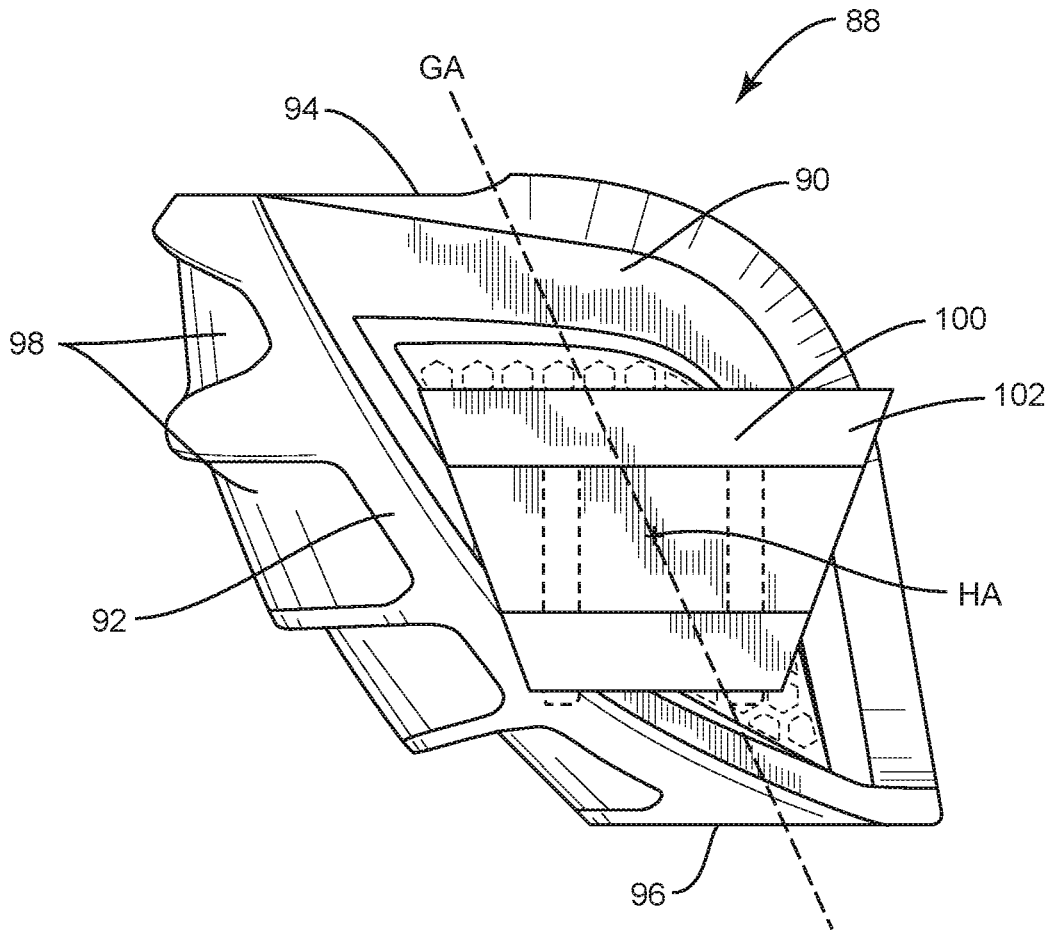
Figure 21D:
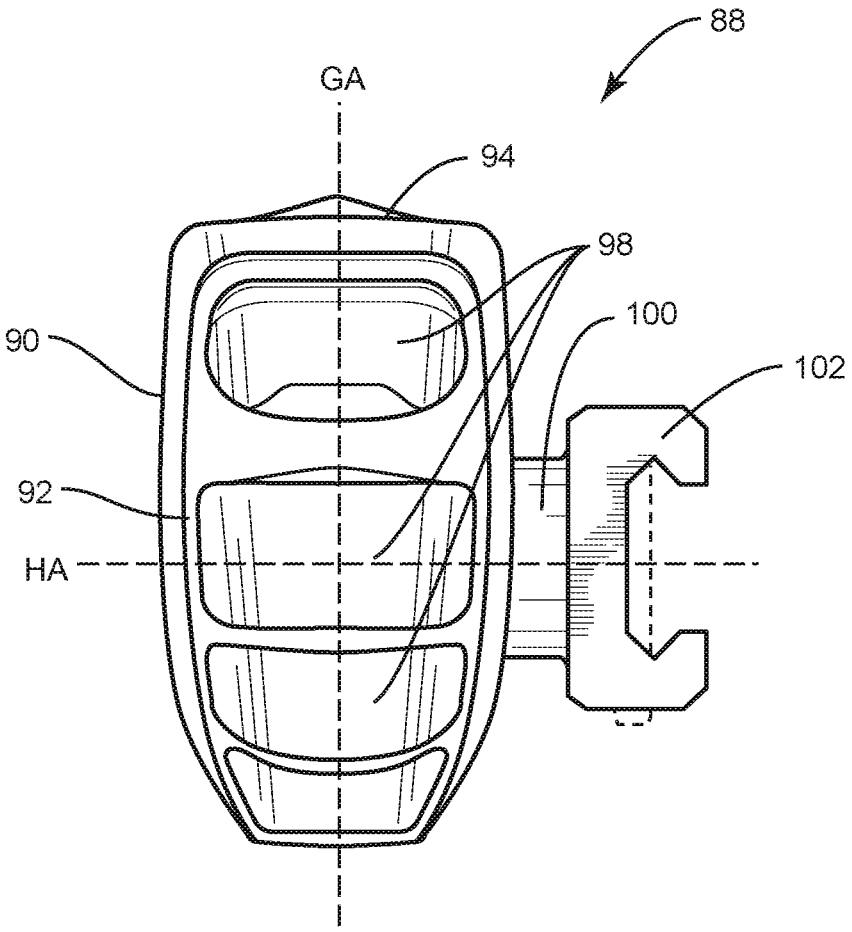
Figure 21E:
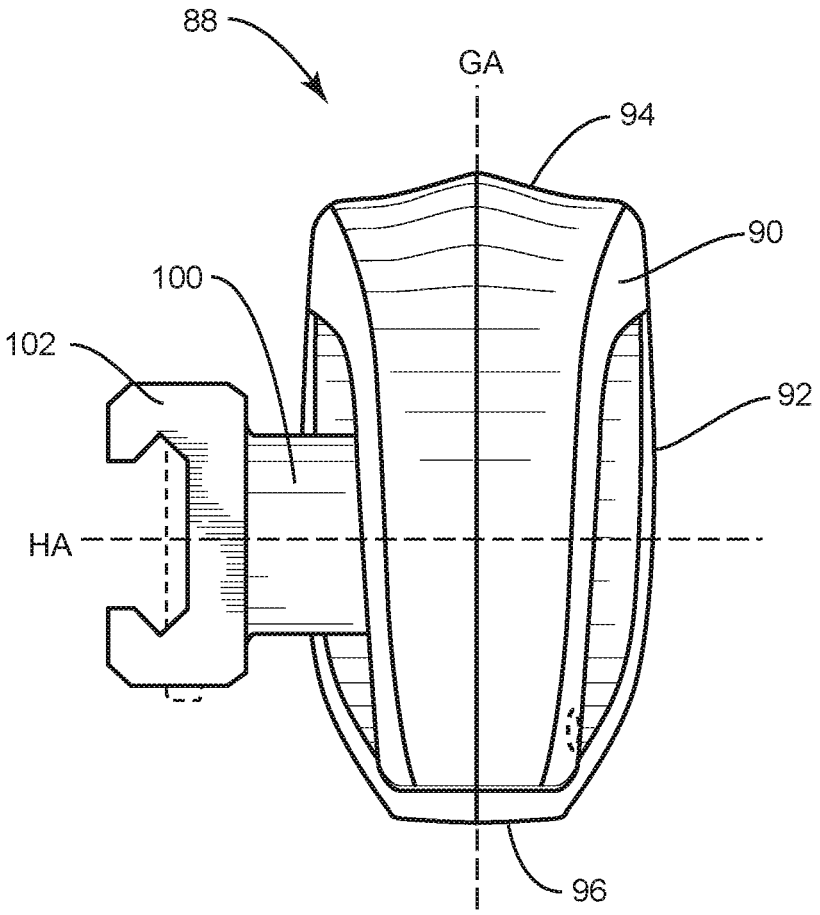
Figure 21F:
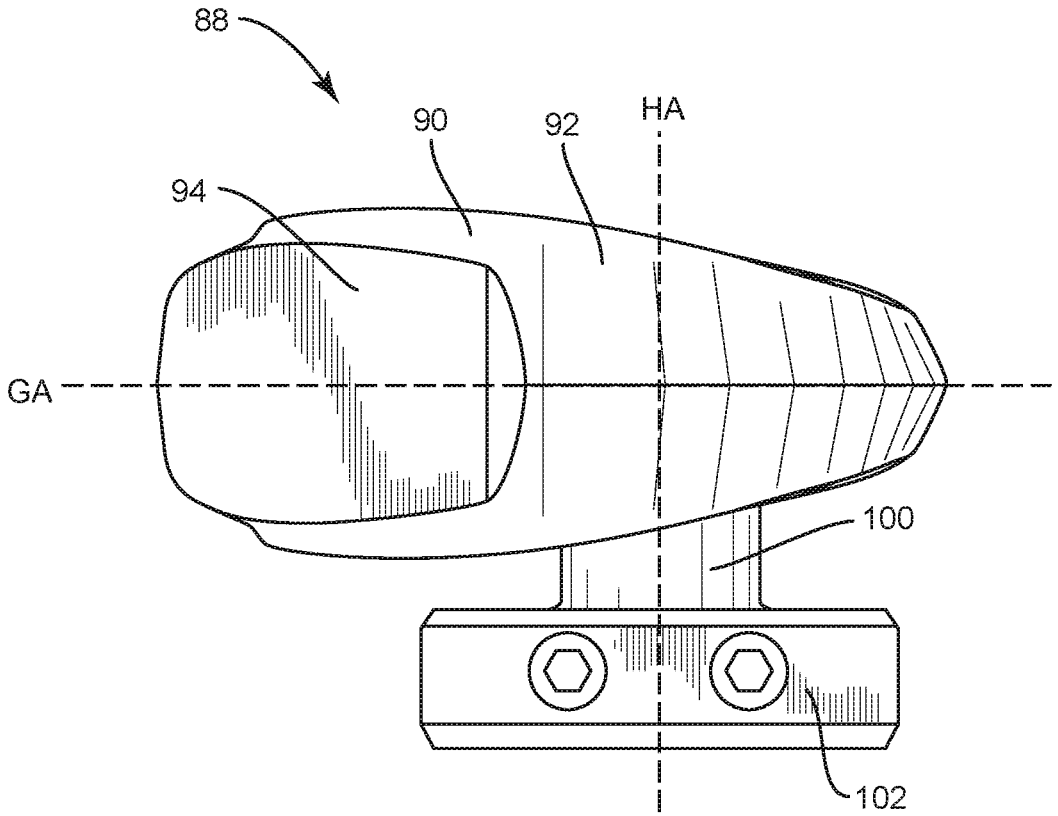
Figure 21G:
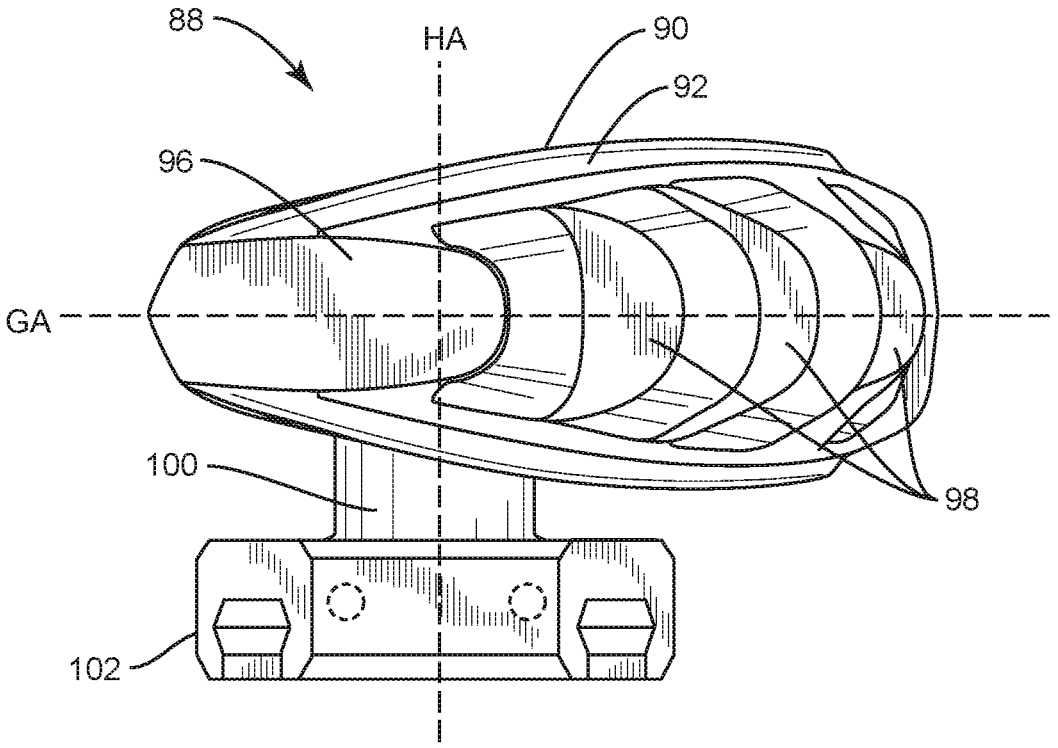

FIGS. 21A-21G illustrate a foregrip 88 including a contoured grip portion 90 according to another embodiment. In particular FIG. 21A is a perspective view of the foregrip 88, and FIGS. 21B-21G are respective right, left, front, rear, top, and bottom views of the foregrip 88. In this example, the foregrip 88 is configured to be mounted on the right side of the fore-end of a long gun and grasped by the right hand of a left-handed user, but it should be understood that this example may be modified for use by a right-handed user by horizontally inverting the elements of the foregrip 88 (i.e., forming a mirror-image of the foregrip 88) in order to form the foregrip 88 that is mountable on the left side of the fore-end of a long gun and grasped by the left hand of a right-handed user.

The foregrip 88 of FIGS. 21A-21G shares many functional features with other embodiments described herein, including many of the features illustrated and described with respect to FIGS. 3-4B, 6B, 8A-8B, 13, 17A-17B, etc. In this example, the grip portion 90 of the foregrip 88 has a grip axis GA and a middle portion 92 configured to be grasped by a hand of a user about the grip axis GA. A top end 94 of the grip portion 90 is disposed above the middle portion 92 and a bottom end 96 of the grip portion 90 is disposed below the middle portion 92. Finger contours 98 are formed along the front of the grip portion 90 to align the user's fingers and palm with respect to the grip portion 90, thereby improving the user's grip on the grip portion 90.

The foregrip 88 also has a coupling portion 100 coupled to the middle portion 92 of the grip portion 90. The coupling portion 100 is configured to be coupled to a fore-end of a long gun having a barrel with a longitudinal axis. In this example, the coupling portion 100 has a Picatinny rail mounting portion 102 configured to secure the coupling portion 100 to a Picatinny rail feature on the fore-end of the long gun (not shown). As with other embodiments described in detail above, the longitudinal axis of the barrel and a grip axis of a rear grip (not shown) define a vertical barrel plane. In this example, the coupling portion 100 is formed as a separate piece from the grip portion 90 and may be fastened on either side of the grip portion 90 during assembly, depending on whether the foregrip 88 is intended for a right-handed or a left-handed user. In other embodiments, the foregrip 88 may be formed as a unitary structure.

The coupling portion 100 is configured to couple the grip portion 90 to the fore-end of the long gun such that the grip axis GA of the grip portion 90 is in a vertical grip plane horizontally offset from the vertical barrel plane, the vertical grip plane is substantially parallel to the vertical barrel plane, and the grip axis GA of the grip portion is substantially parallel to the vertical barrel plane. In this example as well, the coupling portion 100 has a horizontal axis HA substantially perpendicular to the vertical grip plane. In this embodiment, the middle portion 92 is configured to be grasped by a hand of a user about the grip axis GA of the grip portion 90 so that the horizontal axis HA of the coupling portion 100 passes through the hand of the user. This in turn horizontally aligns the user's grip with the center of the fore-end of the long gun, which leads to an increase in stability, accuracy, and comfort for the user.

Those skilled in the art will recognize improvements and modifications to the preferred embodiments of the disclosure. All such improvements and modifications are considered within the scope of the concepts disclosed herein and the claims that follow.

What is claimed is:

1. An axially offset foregrip assembly for a long gun, the foregrip assembly comprising: a grip portion having a first grip axis defined by a longitudinal axis of the grip portion, the grip portion having a first end, a second end, and a middle portion located between the first end and the second end, the middle portion configured to be grasped by a hand of a user about the first grip axis during use of the long gun; a coupling portion coupled to the middle portion of the grip portion, the coupling portion having a coupling axis defined by a longitudinal axis of the coupling portion, the coupling axis being substantially perpendicular to the first grip axis, the coupling portion configured to be coupled to a fore-end of a long gun having a barrel axis defined by a longitudinal axis of the barrel, such that the coupling axis is perpendicular to the barrel axis; and an adjustment mechanism configured to: selectively allow the grip portion to be rotated about the coupling axis; and selectively fix the grip portion in a plurality of rotational positions about the coupling axis, each rotational position defining an angle between the grip axis and the barrel axis between 60 degrees and 120 degrees with respect to a muzzle of the barrel.

2. The foregrip assembly of claim 1, wherein the coupling portion is configured to be coupled to the fore-end of the long gun such that: the barrel axis is in a barrel plane; and the grip axis is in a grip plane that is offset from the barrel plane and parallel to the barrel plane.

3. The foregrip assembly of claim 1, wherein the coupling portion is configured to be coupled to the fore-end of the long gun such that the coupling axis and the barrel axis form a coupling plane.

4. The foregrip assembly of claim 3, wherein the coupling portion is configured to be coupled to the fore-end of the long gun such that: the barrel axis is in a barrel plane that is perpendicular to the coupling plane; and the grip axis is in a grip plane that is offset from the barrel plane and parallel to the barrel plane.

5. The foregrip assembly of claim 1, wherein the middle portion of the grip portion is configured to be grasped by the hand of the user about the first grip axis during firing of the long gun.

6. The foregrip assembly of claim 1, wherein the coupling portion is further configured to be coupled to the fore-end of the long gun via an accessory mounting system.

7. The foregrip assembly of claim 6 wherein the accessory mounting system comprises a rail coupled to the fore-end of the long gun, and wherein the coupling portion is configured to be coupled to the rail.

8. The foregrip assembly of claim 7, wherein the rail is a Picatinny rail.

9. The foregrip assembly of claim 1, wherein the coupling portion comprises: an extension member having a first end coupled to the middle portion of the grip portion, and a second end comprising a fastening feature configured to fixedly attach the second end of the extension member to the fore-end of the long gun.

10. The foregrip assembly of claim 1, further comprising a button disposed on the grip portion, the button configured to be pressed by the user to actuate a function.

11. The foregrip assembly of claim 10, wherein the button is configured to be pressed by the user to actuate the function comprising one or more of: operating a light, operating a laser, operating a camera, or operating a microphone.

12. The foregrip assembly of claim 10, further comprising an accessory port configured to receive an accessory connector of an accessory, the button configured to be pressed by the user to actuate the function comprising operating the accessory via the accessory port and the accessory connector.

13. The foregrip assembly of claim 1, further comprising a storage compartment disposed in the grip portion.

14. A long gun comprising: a fore-end comprising a barrel having barrel axis; an axially offset fore grip sub-assembly coupled to the fore-end, the foregrip sub-assembly comprising: a grip portion having a first grip axis defined by a longitudinal axis of the grip portion, the grip portion having a first end, a second end, and a middle portion located between the first end and the second end, the middle portion configured to be grasped by a hand of a user about the first grip axis during use of the long gun; a coupling portion coupled to the middle portion of the grip portion, the coupling portion having a coupling axis defined by a longitudinal axis of the coupling portion, the coupling axis being substantially perpendicular to the first grip axis, the coupling portion configured to be coupled to a fore-end of a long gun having a barrel axis defined by a longitudinal axis of the barrel, such that the coupling axis is perpendicular to the barrel axis; and an adjustment mechanism configured to: selectively allow the grip portion to be rotated about the coupling axis; and selectively fix the grip portion in a plurality of rotational positions about the coupling axis, each rotational position defining an angle between the grip axis and the barrel axis between 60 degrees and 120 degrees with respect to a muzzle of the barrel.

15. The long gun of claim 14, further comprising a rear grip having a second grip axis defined by a longitudinal axis of the rear grip, wherein: the barrel axis and the second grip axis define a vertical barrel plane, and the grip axis is in a grip plane that is offset from the vertical barrel plane and parallel to the vertical barrel plane.

16. The long gun of claim 14, wherein the coupling axis and the barrel axis form a coupling plane.

17. The long gun of claim 16, further comprising a rear grip having a second grip axis defined by a longitudinal axis of the rear grip, wherein: the barrel axis and the second grip axis define a vertical barrel plane that is perpendicular to the coupling plane, and the grip axis is in a grip plane that is offset from the vertical barrel plane and parallel to the vertical barrel plane.

18. The long gun of claim 14, wherein the long gun is a carbine type rifle.

19. The long gun of claim 14, wherein the long gun is a shotgun.

20. The long gun of claim 19, wherein the fore-end further comprises a forestock, wherein the coupling portion of the foregrip sub-assembly is fixed with respect to the forestock, and wherein the forestock and the foregrip sub-assembly are movable with respect to the barrel in a longitudinal direction parallel to the barrel axis.

* * * * *